US008640905B2

(12) United States Patent
Gibson et al.

(10) Patent No.: US 8,640,905 B2
(45) Date of Patent: Feb. 4, 2014

(54) CONTAINER

(76) Inventors: Daniel Robert Gibson, Meriden, CT (US); Joseph Frank Snecinski, III, Wilmington, DE (US); Todd Aaron Epstein, Salem, MA (US)

( * ) Notice: Subject to any disclaimer, the term of this patent is extended or adjusted under 35 U.S.C. 154(b) by 0 days.

(21) Appl. No.: 13/548,793

(22) Filed: Jul. 13, 2012

(65) Prior Publication Data

US 2013/0180989 A1 Jul. 18, 2013

Related U.S. Application Data

(63) Continuation of application No. 11/509,877, filed on Aug. 25, 2006, now Pat. No. 8,245,866.

(60) Provisional application No. 60/711,197, filed on Aug. 25, 2005.

(51) Int. Cl.
*B65D 17/34* (2006.01)

(52) U.S. Cl.
USPC ..... 220/269; 220/254.2; 220/254.3; 220/254.4; 220/257.2; 220/270; 220/271; 220/367.1; 220/504; 220/906; 222/153.07; 222/478; 222/541.4; 215/44; 215/370; 215/902

(58) Field of Classification Search
USPC ..... 220/254.2, 254.3, 254.4, 257.2, 269, 220/270, 271, 367.1, 504, 906; 222/153.07, 222/478, 541.4; 215/44, 370, 902
See application file for complete search history.

(56) References Cited

U.S. PATENT DOCUMENTS

| | | | | |
|---|---|---|---|---|
| 3,441,169 | A * | 4/1969 | Dunn et al. | 220/271 |
| 3,741,432 | A | 6/1973 | Werth et al. | |
| 3,759,206 | A | 9/1973 | Dalli et al. | |
| 3,856,184 | A | 12/1974 | Luviano | |
| 3,912,114 | A | 10/1975 | Morran et al. | |
| 3,967,752 | A | 7/1976 | Cudzik | |
| 3,977,561 | A | 8/1976 | Strobe et al. | |
| 4,205,760 | A | 6/1980 | Hasegawa | |
| 4,213,538 | A | 7/1980 | Boardman | |
| 4,234,099 | A | 11/1980 | Tarro | |
| 4,585,140 | A | 4/1986 | Lambert et al. | |

(Continued)

FOREIGN PATENT DOCUMENTS

| | | |
|---|---|---|
| EP | 2058240 A1 | 5/2009 |
| EP | 1889796 B1 | 11/2011 |

OTHER PUBLICATIONS

Civil Docket Case No. 1:13-CV-00695-REB, U.S. District Court, District of Colorado (Denver); Complaint for Declaratory Judgment against CML&J, LLC (Filing fee $ 350, Receipt No. 1082-3273067), filed by Ball Metal Beverage Container Corporation. (Attachments: # 1 Exhibit 1, # 2 Exhibit 2, # 3 Exhibit 3, # 4 Exhibit 4, # 5 Exhibit 5, # 6 Exhibit 6, # 7 Exhibit 7, # 8 Exhibit 8, # 9 Exhibit 9, # 10 Exhibit 10, # 11 Civil Cover Sheet)(Gergely, Peter)(Entered: Mar. 15, 2013).

(Continued)

*Primary Examiner* — Anthony Stashick
*Assistant Examiner* — Elizabeth Volz
(74) *Attorney, Agent, or Firm* — Cantor Colburn LLP

(57) ABSTRACT

A container includes a container body defining a container cavity, the container includes a container top configured to create at least two container openings via at least partial depression of at least two container portions into the cavity defined by the container body.

6 Claims, 34 Drawing Sheets

(56) References Cited

U.S. PATENT DOCUMENTS

| | | | | |
|---|---|---|---|---|
| 4,705,186 | A | 11/1987 | Barrash | |
| 4,821,912 | A | 4/1989 | Wells | |
| 4,865,215 | A | 9/1989 | Wells | |
| 4,872,597 | A | 10/1989 | Hanafusa | |
| 5,011,037 | A | 4/1991 | Moen et al. | |
| 5,148,935 | A | 9/1992 | Lyon | |
| 5,285,919 | A * | 2/1994 | Recchia | 220/271 |
| 5,307,947 | A * | 5/1994 | Moen et al. | 220/266 |
| 5,397,014 | A | 3/1995 | Aydt | |
| 5,415,312 | A | 5/1995 | Mueller | |
| 5,494,184 | A | 2/1996 | Noguchi et al. | |
| 5,555,992 | A | 9/1996 | Sedgeley | |
| 5,695,085 | A | 12/1997 | Hadener | |
| 5,741,105 | A | 4/1998 | Schubert et al. | |
| 5,819,973 | A | 10/1998 | Traub, Sr. et al. | |
| 6,079,583 | A | 6/2000 | Chasteen | |
| 6,131,763 | A | 10/2000 | Stanish et al. | |
| 6,889,862 | B2 | 5/2005 | Vaughan | |
| 7,021,481 | B2 | 4/2006 | St. Germain et al. | |
| 7,096,759 | B2 | 8/2006 | Kirko | |
| 7,513,383 | B2 | 4/2009 | Hwang | |
| 7,975,884 | B2 | 7/2011 | Mathabel et al. | |
| 8,113,375 | B2 | 2/2012 | Jeon | |
| 2002/0139800 | A1 | 10/2002 | Hwang et al. | |
| 2003/0098306 | A1 | 5/2003 | Cho | |
| 2003/0189045 | A1 | 10/2003 | Hwang | |
| 2004/0144787 | A1 | 7/2004 | Heck | |
| 2006/0201944 | A1 | 9/2006 | Shibasaka et al. | |

OTHER PUBLICATIONS

Civil Docket Case No. 1:13-CV-00695-REB, U.S. District Court, District of Colorado (Denver); Order for Briefing on Markman Issues. By Judge Robert E. Blackburn on Mar. 22, 2013. (kfinn, ) (Entered: Mar. 22, 2013).

Civil Docket Case No. 1:13-CV-00695-REB, U.S. District Court, District of Colorado (Denver); Summons issued by Clerk. Magistrate Judge Consent Form attached. (Attachments: # 1 Magistrate Judge Consent Form) (kfinn, ) (Entered: Mar. 25, 2013).

Civil Docket Case No. 1:13-CV-00695-REB, U.S. District Court, District of Colorado (Denver); Summons Returned Executed by Ball Metal Beverage Container Corp.. CML&J, LLC served on Mar. 28, 2013, answer due Apr. 18, 2013. (Fletcher, Ryan) (Entered: Apr. 11, 2013).

Civil Docket Case No. 1:13-CV-00695-REB, U.S. District Court, District of Colorado (Denver); Motion to Dismiss Pursuant to FED. R.CIV.P 12(b)(2) and 12(b)(3) by Defendant CML&J, LLC. (Attachments: # 1 Declaration)(Bailey, Rick) (Entered:Apr. 18, 2013).

Civil Docket Case No. 1:13-CV-00695-REB, U.S. District Court, District of Colorado (Denver); Notice of Case Association by Plaintiff Ball Metal Beverage Container Corp. (Fletcher, Ryan) (Entered: Apr. 24, 2013).

Civil Docket Case No. 1:13-CV-00695-REB, U.S. District Court, District of Colorado (Denver);.Notice of Entry of Appearance for Andrew C. Ryan by Rick D. Bailey on behalf of CML&J, LLC (Bailey, Rick) (Entered: Apr. 26, 2013).

Civil Docket Case No. 1:13-CV-00695-REB, U.S. District Court, District of Colorado (Denver);.Notice of Entry of Appearance for Steven M. Coyle by Rick D. Bailey on behalf of CML&J, LLC (Bailey, Rick) (Entered: Apr. 26, 2013).

Civil Docket Case No. 1:13-CV-00695-REB, U.S. District Court, District of Colorado (Denver); Unopposed Motion for Leave to File Excess Pages in Response in Opposition to Defendant CML&J's Motion to Dismiss Pursuant to Fed. R. Civ. P. 12(b)(2) and 12(b)(3) by Plaintiff Ball Metal Beverage Container Corp.. (Gergely, Peter) (Entered:May 8, 2013).

Civil Docket Case No. 1:13-CV-00695-REB, U.S. District Court, District of Colorado (Denver); Minute Order granting 17 Motion for Leave to File Excess Pages. Plaintiff is permitted to file a response brief to the motion to dismiss that shall not exceed twenty-five (25) pages in length. By Judge Robert E. Blackburn on May 9, 2013. Text Only Entry(rebsec, ) (Entered:May 9, 2013).

Civil Docket Case No. 1:13-CV-00695-REB, U.S. District Court, District of Colorado (Denver); Brief in Opposition to 13 Motion to Dismiss Pursuant to FED.R.CIV.P 12(b)(2) and 12(b) (3) filed by Plaintiff Ball Metal Beverage Container Corp.. (Attachments: # 1 Affidavit Declaration of Ryan James Fletcher, # 2 Exhibit A, # 3 Exhibit B, # 4 Exhibit C, # 5 Exhibit D, # 6 Exhibit E, # 7 Exhibit F, # 8 Exhibit G, # 9 Exhibit H, # 10 Exhibit I, # 11 Exhibit J, # 12 Exhibit K, # 13 Exhibit L, # 14 Exhibit M)(Gergely, Peter) (Entered:May 13, 2013).

Civil Docket Case No. 1:13-CV-00695-REB, U.S. District Court, District of Colorado (Denver); Summons Request as to Daniel Robert Gibson re 1 Complaint, by Plaintiff Ball Metal Beverage Container Corporation. (Gergely, Peter) (Entered: Mar. 15, 2013).

Civil Docket Case No. 1:13-CV-00695-REB, U.S. District Court, District of Colorado (Denver); Unopposed Motion for Leave to File Excess Pages In Support of Defendant CML&J's Motion to Dismiss Pursuant to Fed. R. Civ. P. 12(b)(2) and 12(b)(3) by Defendant CML&J, LLC. (Ryan, Andrew) (Entered: May 23, 2013).

Civil Docket Case No. 1:13-CV-00695-REB, U.S. District Court, District of Colorado (Denver); Minute Order granting 20 Defendant CML&J's Unopposed Motion to File an Over Length Reply Brief in Support of its Motion to Dismiss Pursuant to FED. R. CIV. P. 12(b)(2) and 12(b)(3). CML&J may file a reply brief not to exceed 20 pages. By Judge Robert E. Blackburn on May 24, 2013. (klyon, ) (Entered: May 24, 2013).

Civil Docket Case No. 1:13-CV-00695-REB, U.S. District Court, District of Colorado (Denver); Reply to Response to 13 Motion to Dismiss Pursuant to FED.R.CIV.P 12(b)(2) and 12(b) (3) filed by Defendant CML&J, LLC. (Attachments: # 1 Affidavit of Andrew C. Ryan, Esq.) (Ryan, Andrew) (Entered: May 30, 2013).

Civil Docket Case No. 1:13-CV-00695-REB, U.S. District Court, District of Colorado (Denver); Order re: Defendant's 13 Motion to Dismiss Pursuant to Fed.R.Civ.P 12(b)(2) and (b)(3). Defendant CML&J's Motion To Dismiss Pursuant to Fed. R. Civ. P.12(b)(2) and 12(b)(3). [#13], filed Apr. 18, 2013, is Granted in Part and Denied Asmoot in Part. Plaintiff's claims against defendant are Dismissed Withoutprejudice. Judgment without prejudice Shall Enter. By Judge Robert E. Blackburn on Jun. 27, 2013. (klyon, ) (Entered:Jun. 27, 2013).

Civil Docket Case No. 1:13-CV-00695-REB, U.S. District Court, District of Colorado (Denver); Judgment by Clerk in favor of CML &J, LLC against Ball Metal Beverage Container Corp. re: 23 Order on Motion to Dismiss, by Clerk on Jun. 28, 2013. (klyon, ) (Entered: Jun. 28, 2013).

Civil Docket Case No. 1:13-CV-00695-REB, U.S. District Court, District of Colorado (Denver); Report on the determination of an action e-mailed to the Commissioner of Patents. (klyon, ) (Entered: Aug. 13, 2013).

Civil Docket Case No. 1:13-CV-00695-REB, U.S. District Court, District of Colorado (Denver); Corporate Disclosure Statement identifying Corporate Parent Ball Packaging Corporation for Ball Metal Beverage Container Corporation. (Gergely, Peter) (Entered:Mar. 15, 2013).

Civil Docket Case No. 1:13-CV-00695-REB, U.S. District Court, District of Colorado (Denver); Report on the filing of an action mailed to Commissioner of Patents. (agarc, ) (Entered:Mar. 18, 2013).

Civil Docket Case No. 1:13-CV-00695-REB, U.S. District Court, District of Colorado (Denver); Summons issued by Clerk. Magistrate Judge Consent Form attached. (Attachments: # 1Magistrate Judge Consent Form) (agarc, ) (Entered: Mar. 18, 2013).

Civil Docket Case No. 1:13-CV-00695-REB, U.S. District Court, District of Colorado (Denver); Memorandum Returning Case by Senior Judge Daniel. (jjhsl, ) (Entered:Mar. 22, 2013).

Civil Docket Case No. 1:13-CV-00695-REB, U.S. District Court, District of Colorado (Denver); Summons Request as to CML&J, LLC by Plaintiff Ball Metal Beverage Container Corp..(Fletcher, Ryan) (Entered: Mar. 22, 2013).

U.S. District Court, District of Colorado (Denver), Civil Docket for Case #: 1:13-cv-00695-REB, *Ball Metal Beverage Container Corp.*

(56) References Cited

OTHER PUBLICATIONS vs. *CML&J LLC*, Date Filed Mar. 15, 2013, pp. 1-4; http://ecf.ctd.uscourts.gov/cgi-bin/DktRpt.pl?827239800416188-L_1_0-1.
Civil Docket Case No. 3:12-CV-01465-VLB, U.S. District Court, District of Connecticut (New Haven); Order granting 14 Motion for Attorney(s) Ryan James Fletcher, Ph.D., Esq. to be admitted pro hac vice. Certificate of Good Standing due by May 5, 2013. Signed by Clerk on Mar. 6, 2013. (Grady, B.) (Entered: Mar. 6, 2013).
Civil Docket Case No. 3:12-CV-01465-VLB, U.S. District Court, District of Connecticut (New Haven); Complaint against MillerCoors LLC ( Filing fee $350 receipt No. 0205-2656473.), filed by CML&J LLC. (Attachments: # 1 Exhibit A-Patent US8425866)(Coyle, Steven) (Entered: Oct. 15, 2012).
Civil Docket Case No. 3:12-CV-01465-VLB, U.S. District Court, District of Connecticut (New Haven); Notice of Appearance by James T. Shearin on behalf of MillerCoors LLC (Shearin, James) (Entered: Mar. 4, 2013).
Civil Docket Case No. 3:12-CV-01465-VLB, U.S. District Court, District of Connecticut (New Haven); Defendant's Answer to 1 Complaint with Affirmative Defenses and Special Defenses with Jury Demand by MillerCoors LLC.(Shearin, James) (Entered: Mar. 4, 2013).
Civil Docket Case No. 3:12-CV-01465-VLB, U.S. District Court, District of Connecticut (New Haven); Corporate Disclosure Statement by MillerCoors LLC identifying Other Affiliate Miller Brewing Company, Other Affiliate MC Holding Company LLC for MillerCoors LLC. (Shearin, James) (Entered: Mar. 4, 2013).
Civil Docket Case No. 3:12-CV-01465-VLB, U.S. District Court, District of Connecticut (New Haven); Motion for Attorney(s) Peter A. Gergeley to be Admitted Pro Hac Vice (paid $75 PHV fee; receipt No. 0205-2798255) by MillerCoors LLC. (Attachments: # 1 Affidavit of Peter Gergeley)(Shearin, James) (Entered: Mar. 5, 2013).
Civil Docket Case No. 3:12-CV-01465-VLB, U.S. District Court, District of Connecticut (New Haven); Motion for Attorney(s) Ryan James Fletcher, Ph.D., Esq. to be Admitted Pro Hac Vice (paid $75 PHV fee; receipt No. 0205-2798257) by MillerCoors LLC. (Attachments: # 1 Affidavit of Ryan James Fletcher, Ph.D.) (Shearin, James) (Entered: Mar. 5, 2013).
Civil Docket Case No. 3:12-CV-01465-VLB, U.S. District Court, District of Connecticut (New Haven); Order granting 13 Motion for Attorney(s) Peter A. Gergeley to be admitted pro hac vice. Certificate of Good Standing due by May 5, 2013. Signed by Clerk on Mar. 6, 2013. (Grady, B.) (Entered: Mar. 6, 2013).
Civil Docket Case No. 3:12-CV-01465-VLB, U.S. District Court, District of Connecticut (New Haven); Certificate of Good Standing re 14 Motion for Attorney(s) Ryan James Fletcher, Ph.D., Esq. to be Admitted Pro Hac Vice (paid $75 PHV fee; receipt No. 0205-2798257) by MillerCoors LLC. (Fletcher, Ryan) (Entered: Mar. 11, 2013).
Civil Docket Case No. 3:12-CV-01465-VLB, U.S. District Court, District of Connecticut (New Haven); Memorandum in Opposition re 18 Motion to Stay re 1 Complaint Motion to Transfer to Another District filed by CML&J LLC. (Attachments: # 1 Affidavit of Daniel Gibson, # 2 Affidavit of Andrew Ryan, # 3 Exhibit '866 Patent, # 4 Exhibit Molson Form 10-K, # 5 Exhibit Ball Corporation Form 10-K, # 6 Exhibit CML&J Motion to Dismiss) (Coyle, Steven) (Entered:Apr. 24, 2013).
Civil Docket Case No. 3:12-CV-01465-VLB, U.S. District Court, District of Connecticut (New Haven); Order on Pretrial Deadlines: Motions to Dismiss due on Jan. 15, 2013. Amended Pleadings due by Dec. 14, 2012 Discovery due by Apr. 16, 2013 Dispositive Motions due by May 16, 2013. Signed by Clerk on Oct. 15, 2012. (LaLone, L.) (Entered: Oct. 15, 2012).
Civil Docket Case No. 3:12-CV-01465-VLB, U.S. District Court, District of Connecticut (New Haven); Motion for Leave to File Excess Pages by MillerCoors LLC. (Shearin, James) (Entered:May 2, 2013).
Civil Docket Case No. 3:12-CV-01465-VLB, U.S. District Court, District of Connecticut (New Haven); Order granting 20 Motion for Leave to File Excess Pages. Signed by Judge Vanessa L. Bryant on May 3, 2013. (Ives, D) (Entered: May 3, 2013).
Civil Docket Case No. 3:12-CV-01465-VLB, U.S. District Court, District of Connecticut (New Haven); Reply to Response to 18 Motion to Stay re 1 Complaint Motion to Transfer to Another District filed by MillerCoors LLC. (Attachments: # 1 Declaration of Ryan J. Fletcher, # 2 Exhibit 10, # 3 Exhibit 11, # 4 Exhibit 12, # 5 Exhibit 13, # 6 Exhibit 14)(Shearin, James) (Entered: May 8, 2013).
Civil Docket Case No. 3:12-CV-01465-VLB, U.S. District Court, District of Connecticut (New Haven); Certificate of Good Standing re 13 Motion for Attorney(s) Peter A. Gergeley to be Admitted Pro Hac Vice (paid $75 PHV fee; receipt No. 0205-2798255) by MillerCoors LLC. (Gergely, Peter) (Entered: May 9, 2013).
Civil Docket Case No. 3:12-CV-01465-VLB, U.S. District Court, District of Connecticut (New Haven); Motion for Leave to File Surreply Brief in Opposition to Defendant's Motion to Transfer or to Stay by CML&J LLC. (Attachments: # 1 Exhibit Proposed Surreply)(Coyle, Steven) (Entered: May 17, 2013).
Civil Docket Case No. 3:12-CV-01465-VLB, U.S. District Court, District of Connecticut (New Haven); Memorandum in Opposition re 24 Motion for Leave to File Surreply Brief in Opposition to Defendant's Motion to Transfer or to Stay filed by MillerCoors LLC. (Shearin, James) (Entered: May 21, 2013).
Civil Docket Case No. 3:12-CV-01465-VLB, U.S. District Court, District of Connecticut (New Haven); Reply to Response to 24 Motion for Leave to File Surreply Brief in Opposition to Defendant's Motion to Transfer or to Stay filed by CML&J LLC. (Coyle, Steven) (Entered:May 22, 2013).
Civil Docket Case No. 3:12-CV-01465-VLB, U.S. District Court, District of Connecticut (New Haven); Notice of Additional Authority re 18 Motion to Stay re 1 Complaint Motion to Transfer to Another District filed by CML&J LLC. (Attachments: # 1 Court Order Dismissing Colorado Action)(Coyle, Steven) (Entered: Jun. 27, 2013).
Civil Docket Case No. 3:12-CV-01465-VLB, U.S. District Court, District of Connecticut (New Haven); Joint Report of Rule 26(f) Planning Meeting. (Attachments: # 1 Appendix A—Local Patent Rules, # 2 Appendix B—ESI Production Specifications)(Coyle, Steven) (Entered: Jul. 25, 2013).
Civil Docket Case No. 3:12-CV-01465-VLB, U.S. District Court, District of Connecticut (New Haven); Stipulation , Protective Order by CML&J LLC, MillerCoors LLC (Coyle, Steven) Modified on Sep. 5, 2013 to add filer (Grady, B.). (Entered: Aug. 30, 2013).
Civil Docket Case No. 3:12-CV-01465-VLB, U.S. District Court, District of Connecticut (New Haven); Electronic Filing Order—Please Ensure Compliance With Courtesy Copy Requirements in This Order. Signed by Judge Vanessa L. Bryant on Oct. 15, 2012. (LaLone, L.) (Entered: Oct. 15, 2012).
Civil Docket Case No. 3:12-CV-01465-VLB, U.S. District Court, District of Connecticut (New Haven); Notice of Additional Authority re 18 Motion to Stay re 1 Complaint Motion to Transfer to Another District filed by MillerCoors LLC. (Attachments: # 1 Exhibit A)(Shearin, James) (Entered: Sep. 6, 2013).
Civil Docket Case No. 3:12-CV-01465-VLB, U.S. District Court, District of Connecticut (New Haven); Notice of Appearance by Andrew C. Ryan on behalf of CML&J LLC (Ryan, Andrew) (Entered: Sep. 6, 2013).
Civil Docket Case No. 3:12-CV-01465-VLB, U.S. District Court, District of Connecticut (New Haven); Order RE: Judge's Chambers Practices. Counsel are directed to read and comply with the Chambers Practices and Standing Orders prior to filing any document. So ordered. Signed by Judge Vanessa L. Bryant on Oct. 15, 2012. (LaLone, L.) (Entered: Oct. 15, 2012).
Civil Docket Case No. 3:12-CV-01465-VLB, U.S. District Court, District of Connecticut (New Haven); Notice to Counsel: Counsel initiating or removing this action is responsible for serving all parties with attached documents and copies of 1 Complaint filed by CML&J LLC, 3 Electronic Filing Order, 2 Order on Pretrial Deadlines, 4 Order Re: Chambers Practices. Signed by Clerk on Oct. 15, 2012. (LaLone, L.) (Entered: Oct. 15, 2012).
Civil Docket Case No. 3:12-CV-01465-VLB, U.S. District Court, District of Connecticut (New Haven); AO 120 Report on the Filing of an Action re: Patent or Trademark Form Completed (LaLone, L.) (Entered: Oct. 15, 2012).

(56) References Cited

OTHER PUBLICATIONS

Civil Docket Case No. 3:12-CV-01465-VLB, U.S. District Court, District of Connecticut (New Haven); Electronic Summons Issued in accordance with Fed. R. Civ. P. 4 and LR 4 as to *MillerCoors LLC* with answer to complaint due within *21* days. Attorney *Steven M. Coyle* *Cantor Colburn LLP—Htfd* *20 Church Street, 22nd Floor* *Hartford, CT 06103*. (LaLone, L.) (Entered: Oct. 15, 2012).
Civil Docket Case No. 3:12-CV-01465-VLB, U.S. District Court, District of Connecticut (New Haven); First Summons Returned Executed by CML&J LLC. MillerCoors LLC served on Feb. 11, 2013, answer due Mar. 4, 2013. (Coyle, Steven) (Entered: Feb. 19, 2013).
Civil Docket Case No. 3:12-CV-01465-VLB, U.S. District Court, District of Connecticut (New Haven); Second Summons Returned Executed by CML&J LLC. (Coyle, Steven) (Entered:Feb. 19, 2013).
Maxwell, D.B.S., Beer Cans: A Guide for the Archaeologist; Historical Archaeology, 1993, 27 (1):95-113, pp. 95-113.
U.S. District Court, District of Connecticut (New Haven), Civil Docket for Case #: 3:12-cv-01465-VLB, *CML&J LLC* vs. *MillerCoors LLC*, Date Filed: Oct. 15, 2012, pp. 1-4; http://ecf.ctd.uscourts.gov/cgi-bin/DktRpt.pl?913385316747584-L_1_0-1.
Civil Docket Case No. 3:12-CV-01465-VLB, U.S. District Court, District of Connecticut (New Haven); Defendant MillerCoors LLC's Preliminary Non-Infringement and Invalidty Contentions; Oct. 25, 2013; Exhibits A and B included.

* cited by examiner

CONTAINER

CROSS-REFERENCE TO RELATED APPLICATIONS

This application is a continuation of U.S. patent application Ser. No. 11/509,877 filed on Aug. 25, 2006, which claims the benefit of U.S. Provisional Patent Application No. 60/711,197 filed Aug. 25, 2005, both of which applications are herein incorporated by reference.

FIELD OF THE INVENTION

The present invention relates generally to a beverage container and more particularly to an improved beverage container that allows for an improved flow of fluid from the container.

BACKGROUND OF THE INVENTION

Since before the Second World War, the beverage industry has been packaging and selling beverages in aluminum cans. Over the years this industry has seen numerous innovations relating to can style and functionality, wherein the first generation of aluminum cans included "cone top" and "flat top" cans. True to their names, the cone top can included a conical top sealed off by a removable cap, while the flat top can included a flat top, which allowed beverage access using a device called a "church key," which was basically a can opener used to puncture the top of the can. By 1960 cone top can production ceased, yielding to the popularity of the flat top can. Around this same time however, an innovation in the beverage can industry known as the "zip top" or "pull tab," was developed, and threatened to overtake the flat top's market hold. The zip top allowed a user to grasp a metallic tab attached to a spout shaped portion of the can top and pull the tab and portion of the top completely off of the can, creating a can opening which allowed access to the contents within. The convenience of the zip top can was readily apparent, and by the late 1960's the flat top can was starting to be replaced by the zip top can.

Although the zip top can was convenient an most likely boosted beverage can sales in general, it also had a couple of disadvantages. First of all, the loose pull tabs which came off the cans were damaging to the environment. Pets and wildlife died from ingesting pull tabs, as did more than a few people who dropped them into their beverage can and accidentally choked on them. Moreover, these tabs not only wound up on beaches, where beachgoers cut their feet on them, they also littered roadsides and damaged garbage disposals. One response to address these disadvantages involved the development of the "stay tab."

Introduced in 1975, the stay tab was designed to stay connected to the can. The tab is essentially hinged to the top of a can in a manner that allows a consumer to pull up on a ring end of the tab, causing the opposite end of the tab to press down on a perforated portion of the top of the can. As the ring end of the tab is pulled upward, the opposite end pierces the can top along the perforation, remaining with the can until recycling/disposal. While the metal attaching the tab to the can top bends to allow piercing of the perforation, it does not readily break off the top of the can, thus alleviating the tab filled environment created by the pull tab. Today, virtually all beverages sold in cans are marketed in cans with stay tabs.

Unfortunately however, while the disadvantage of loose tabs was addressed by the advent of the stay tab can, a disadvantage relating to beverage flow from the stay tab can and its predecessors remained. When a fluid is poured from a can opening a vacuum is created within the can which sucks air into the can as the fluid flows out. If a can has one opening, air must flow into that opening as the fluid is poured out of that opening, causing the fluid to exit the can in an uneven, almost violent flow. This uneven flow may cause a carbonated beverage to lose carbonation more quickly than a fluid being poured in a smooth, even flow. Additionally, fluid flowing from a can opening in this manner does so in a messier and slower manner.

One way of creating a smoother, more even flow involves equalizing the pressure between the inside and outside of the can, which may be accomplished by creating a second can opening. Creation of a second can opening can allow air to enter the can via this second opening while fluid leaves the can via the first opening, alleviating the unevenness and violence of the flow discussed above. Unfortunately however, current cans do not provide container top conducive to creating a second can opening.

BRIEF DESCRIPTION OF THE INVENTION

Disclosed is an improved container including a container body defining a container cavity, the improved container including a container top configured to create at least two container openings via at least at least partial depression of at least two container portions into the cavity defined by the container body.

Also disclosed is an improved container including a container body defining a container cavity, the container including a container top configured to create at least two container openings via at least one of cavity devise associated with the container top and disposed at least partially in the container cavity defined by the container body, and an extending tab portion that is extendable from a tab associated with the container top.

Further disclosed is a method for improving a flow of a fluid from a container including a container cavity defined by a container body, the method including configuring a container top to allow creation of at least two openings in the container top via an at least partial depressing of at least two container portions into the cavity defined by the container body.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
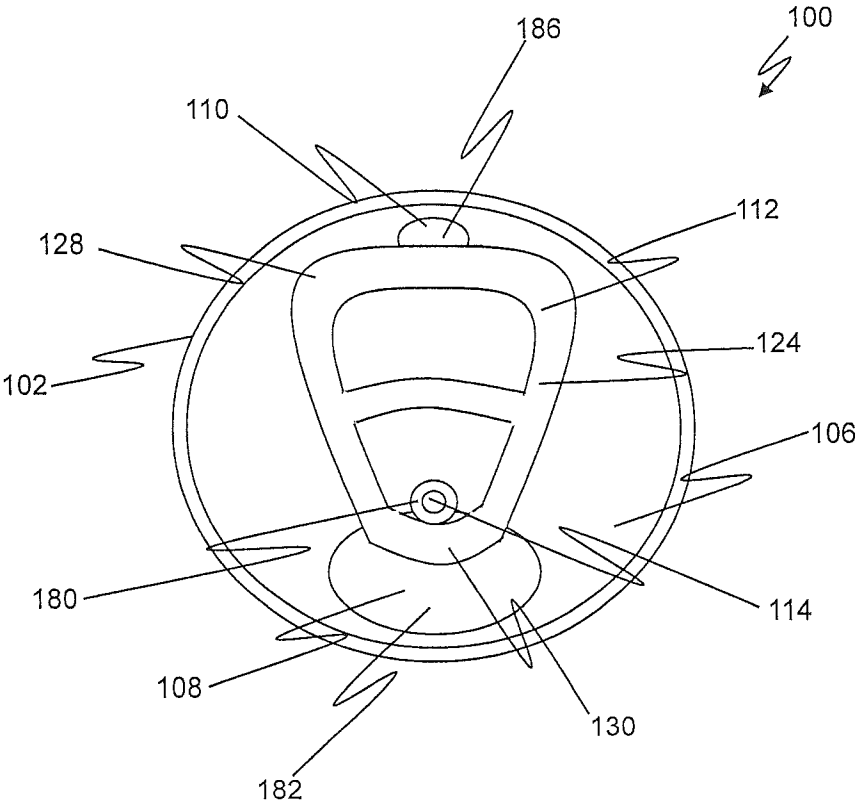
FIG. 1 is a top view of an improved container in accordance with a first embodiment.

Referring to FIGS. 1-7, a first exemplary embodiment of an improved container 100 is illustrated and includes a container body 102 defining a container cavity 104 for containing a fluid 116. A container top 106 is also included, wherein the container top 106 is associated with the container body 102 to sealingly enclose the container cavity 104. A tab 112 is additionally provided and includes a grip end 128, a depressing end 130, and a tab-securing ring 180. The tab-securing ring 180 is sized and shaped to securely associate the tab 112 to the container top 106 via an attaching structure 114. At least one of the container top 106 and tab 112 are configured to facilitate the creation of at least two openings in the container top 106. In order to facilitate the creation of these at least two openings, the container top 106 includes at least two areas for opening, as illustrated by a first portion 108 configurable between a closed configuration 182 and an open configuration 184, and a second portion 110 configurable between a closed configuration 186 and a open configuration 188.

Figure 2:
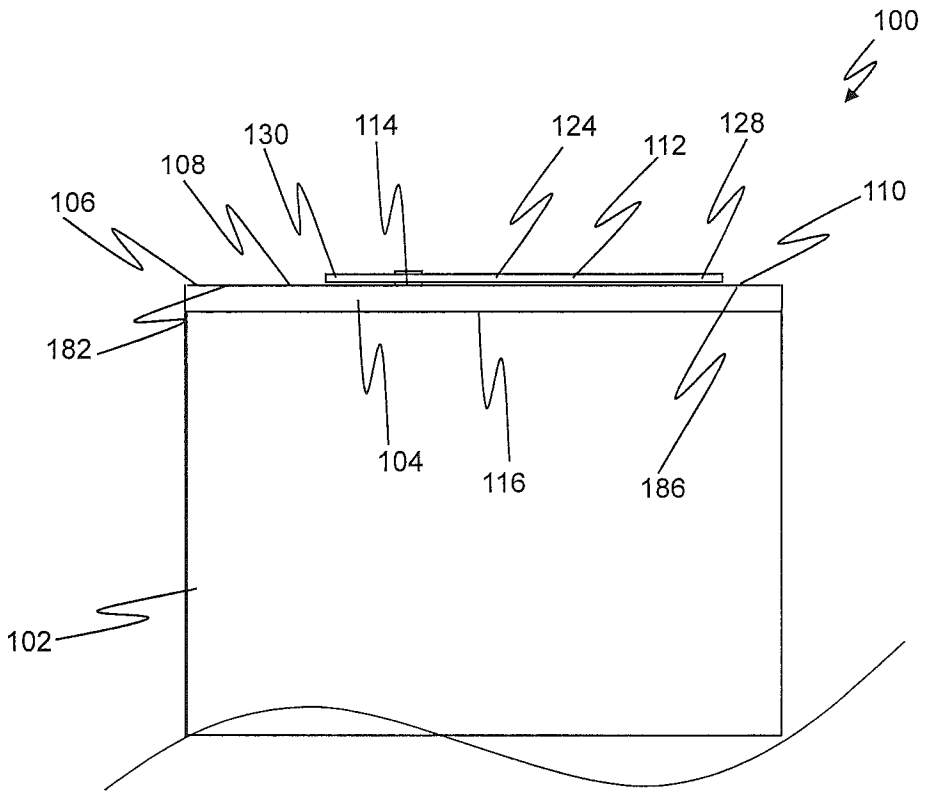
FIG. 2 is a cross-section of an improved container in accordance with the first embodiment.
Figure 3:
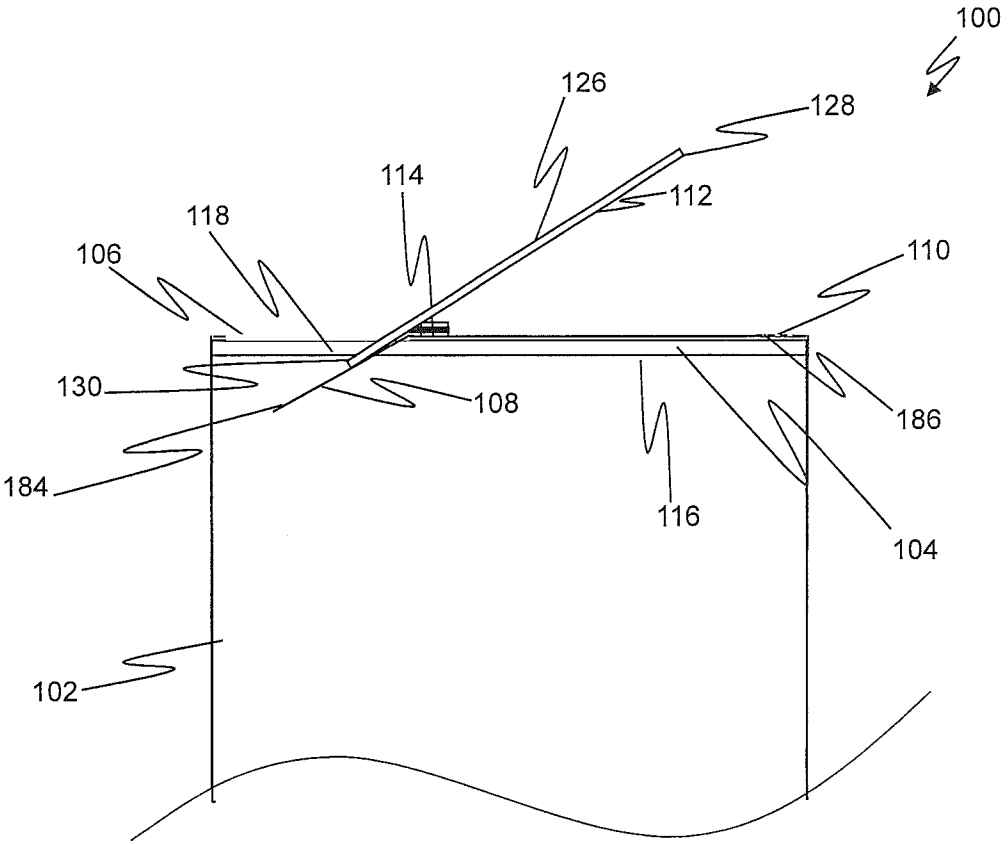
FIG. 3 is a cross-section of an improved container in accordance with the first embodiment.
Figure 4:
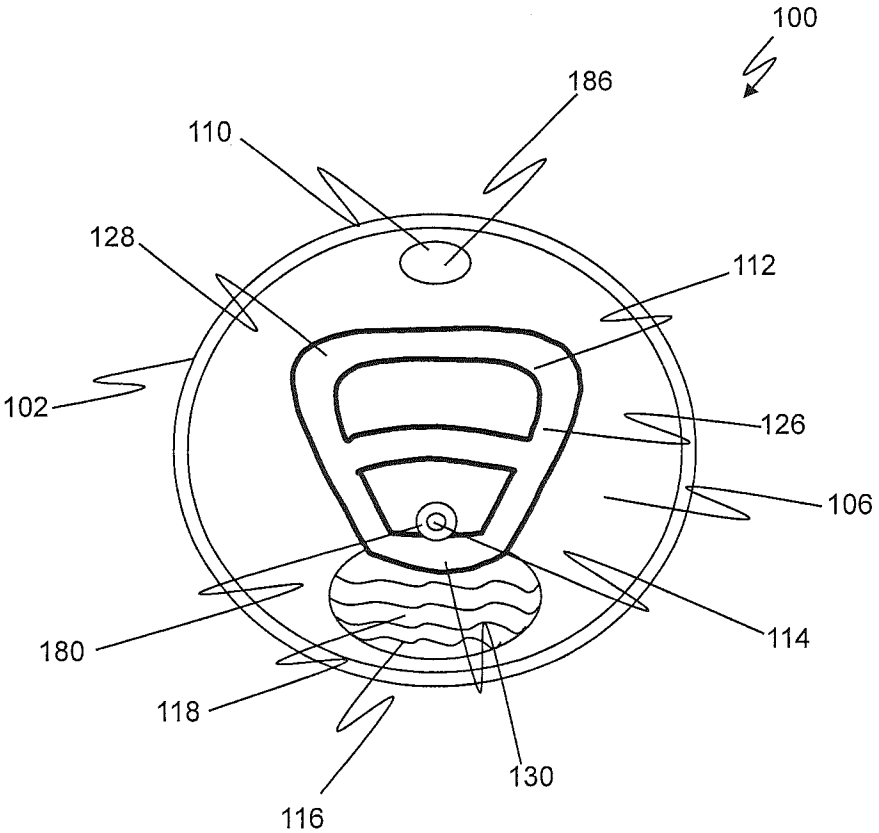
FIG. 4 is a top view of an improved container in accordance with the first embodiment.

Referring to FIG. 2 and FIG. 3, the tab 112 is at least configurable between a first position 124 and a second position 126. Referring to FIG. 2, the tab 112 is illustrated in the first position 124, lying substantially parallel to the container top 106 with the depressing end 130 being disposed adjacent to the first portion 108. Referring to FIG. 3, as the grip end 128 is raised into the second position 126, the depressing end 130 pushes down on the first portion 108 causing the first portion 108 to at least partially separate from the container top 106 and move down into the container cavity 104. As FIG. 3 and FIG. 4 illustrate, raising the grip end 128 of the tab 112 causes the depressing end 130 to depress the first portion 108, creating a first container opening 118 which allows access to the fluid 116 within the container cavity 104.

Figure 5:
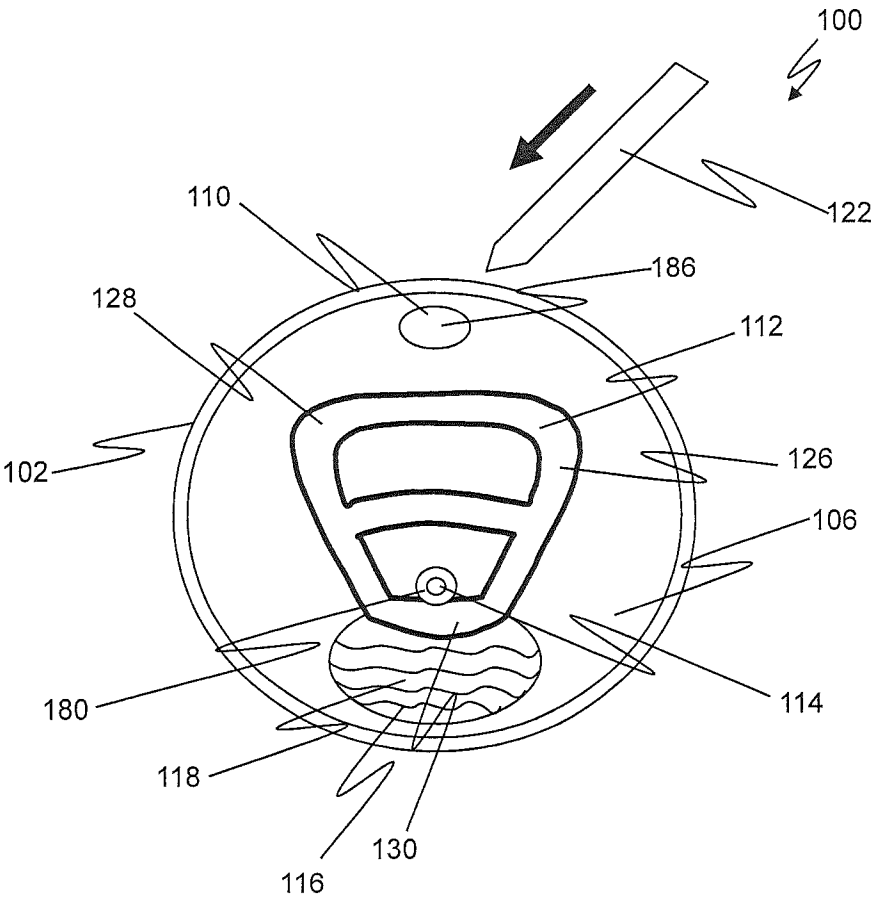
FIG. 5 is a top view of an improved container in accordance with the first embodiment.
Figure 6:
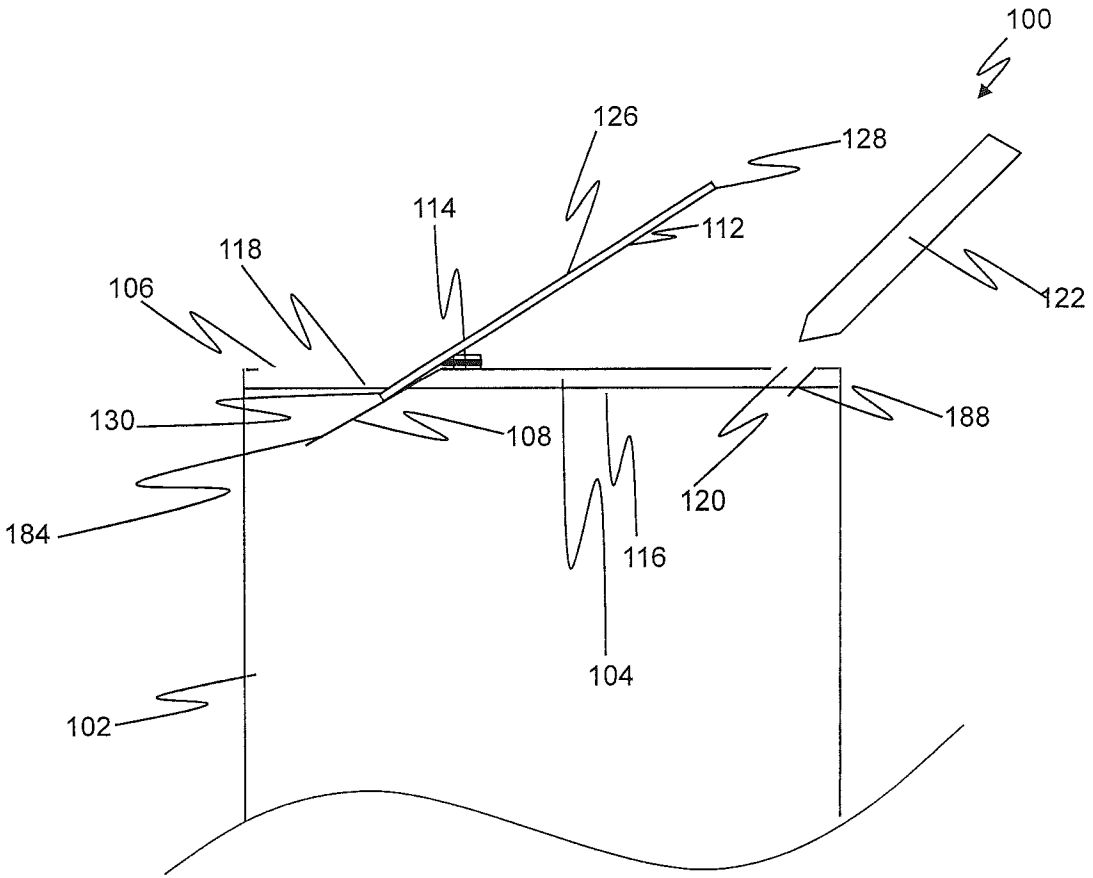
FIG. 6 is a cross-section of an improved container in accordance with the first embodiment.
Figure 7:
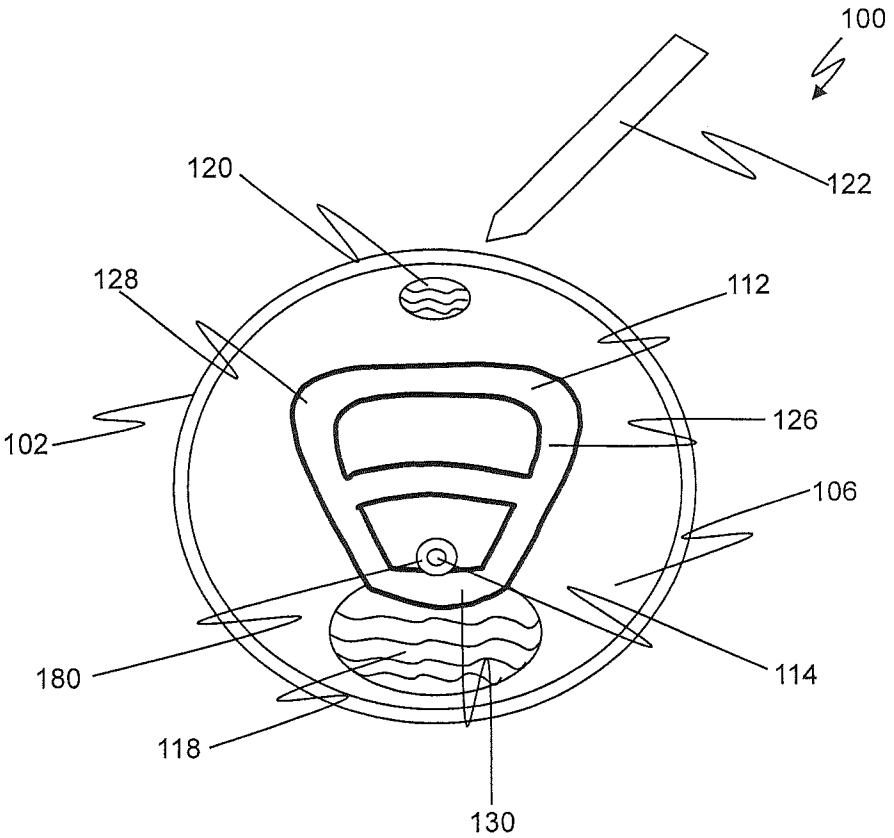
FIG. 7 is a top view of an improved container in accordance with the first embodiment.
Figure 8:
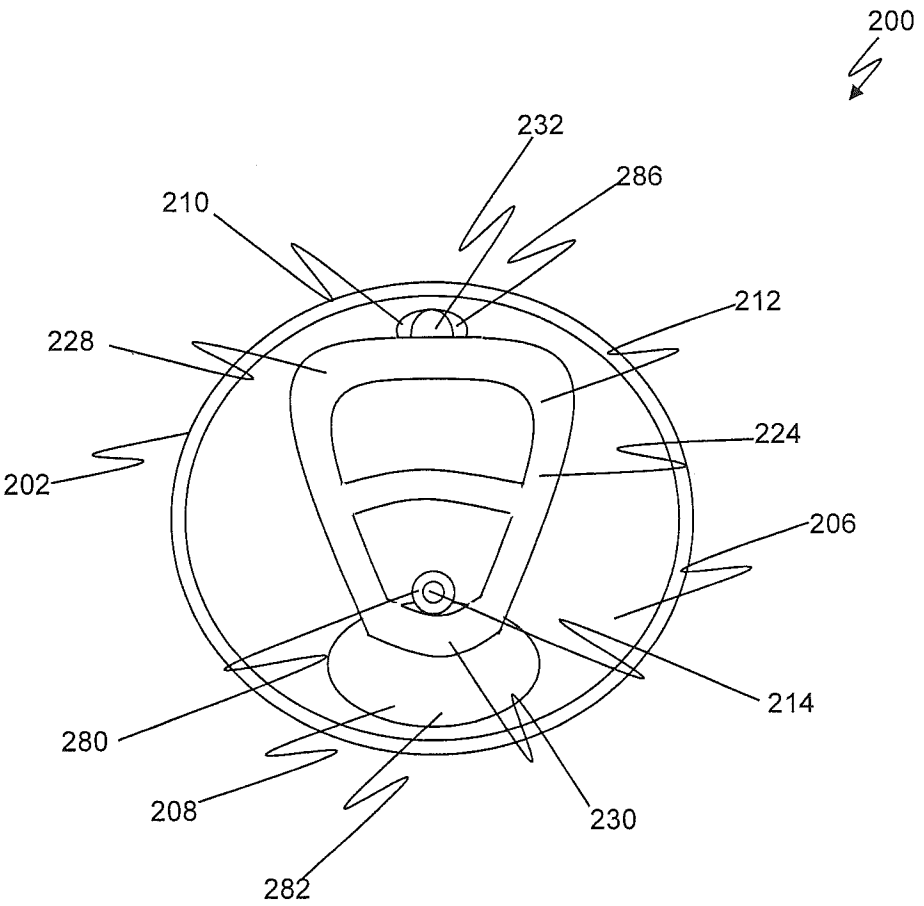
FIG. 8 is a top view of an improved container in accordance with a second embodiment.

Referring to FIG. 5, the first embodiment of the improved container 100 is further illustrated with an actuation device 122 which may be used to depress and at least partially separate the second portion 110 from the container top 106. FIG. 6 illustrates the second portion 110 having been at least partially separated from the container top 106, and depressed (by the actuation device 122) into the container cavity 104, thus creating, as illustrated in FIGS. 6 and FIG. 7, a second container opening 120. This second container opening 120 allows air to enter the container cavity 104 while the fluid 116 flows from the first can opening 108, thus creating a more even and steady pour.

It should be appreciated that the container body 102 and container top 106 may be made from any material suitable to containing the fluid 116, such as aluminum and tin. Additionally, the fluid 116 may be any gas, liquid, or combination thereof, including carbonated beverages such as soda, beer, and tonic. It should further be appreciated that the container top 106 may be molded from the same continuous piece of material as the container body 102, thus making the container body 102 and container top 106 a one piece, fluid 116 containing device. Also, the attachment 114 of the tab 112 to the container top 106 may be achieved via any means suitable to the desired end purpose of moveable flexibility, including frictional, welding, and snap-on associations. Still further, it should be appreciated that the actuation device 122 may be sold with the improved container 100, removably attached to the container body 102 or package which holds at least one improved container 100.

Figure 9:
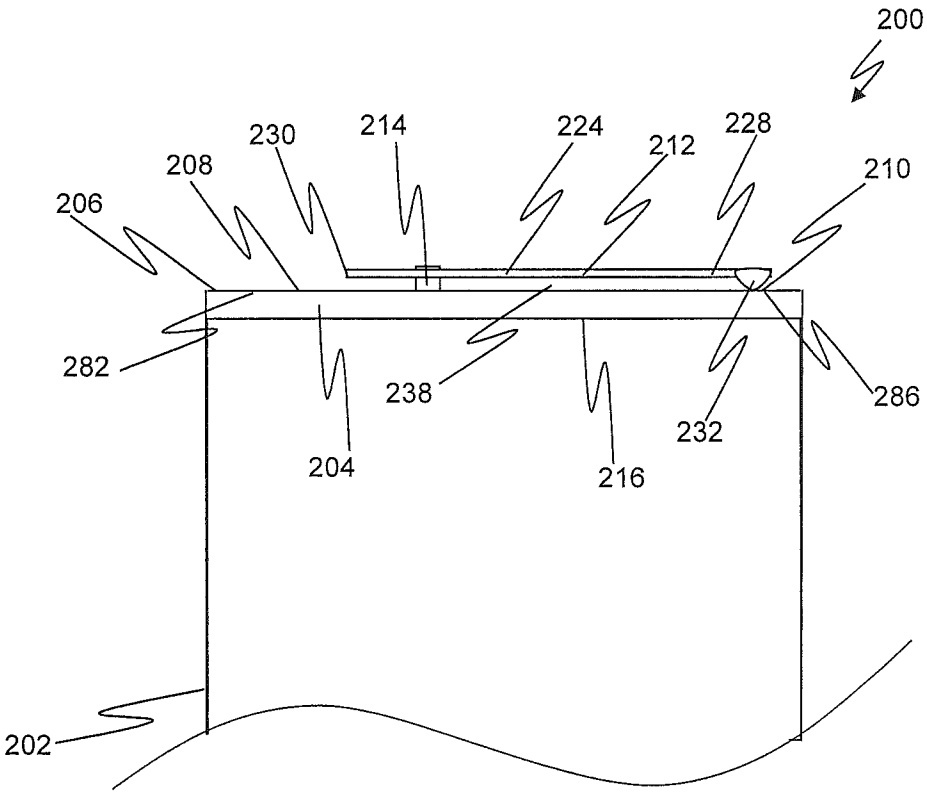
FIG. 9 is a cross-section of an improved container in accordance with the second embodiment.

Referring to FIGS. 8-13, a second exemplary embodiment of an improved container 200 is illustrated and includes a container body 202 defining a container cavity 204 containing a fluid 216. A container top 206 is also included, wherein the container top 206 is associated with the container body 202 to sealingly enclose the container cavity 204. A tab 212 is additionally provided and includes a grip end 228, a depressing end 230, at least one protruding instrument 232 and a tab-securing ring 280. The tab-securing ring 280 is sized and shaped to securely associate the tab 212 to the container top 206 via an attaching structure 214. At least one of the container top 206 and tab 212 are configured to facilitate the creation of at least two openings in the container top 206. Referring to FIG. 9, in order to facilitate the creation of these at least two openings, the container top 206 includes at least two areas for opening, as illustrated by a first portion 208 configurable between a closed configuration 282 and an open configuration 284, and a second portion 210 configurable between a closed configuration 286 and a open configuration 288.

Figure 10:
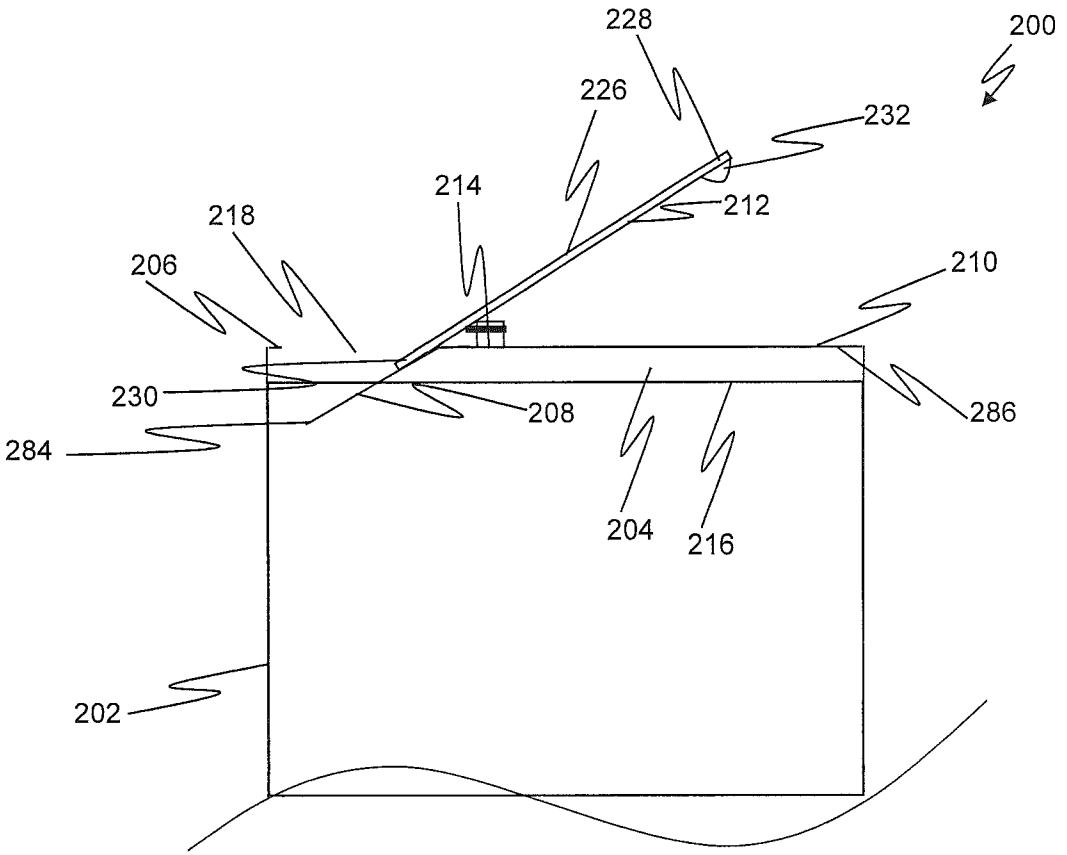
FIG. 10 is a cross-section of an improved container in accordance with the second embodiment.

Referring to FIG. 9 and FIG. 10, FIG. 11, and FIG. 12, the tab 212 is at least configurable between a first position 224, a second position 226, a third position 234, and a fourth position 236. Referring to FIG. 9, the tab 212 is illustrated in the first position 224, lying substantially parallel to the container top 206 with the depressing end 230 being disposed adjacent to the first portion 208. Referring to FIG. 10, as the grip end 228 is raised into the second position 226, the depressing end 230 pushes down on the first portion 208 causing the first portion 208 to at least partially separate from the container top 206 and move down into the container cavity 204. As FIG. 9 and FIG. 10 illustrate, raising the grip end 228 of the tab 212 causes the depressing end 230 to depress the first portion 208, creating a first container opening 218 which allows access to the fluid 216 within the container cavity 204.

Figure 11:
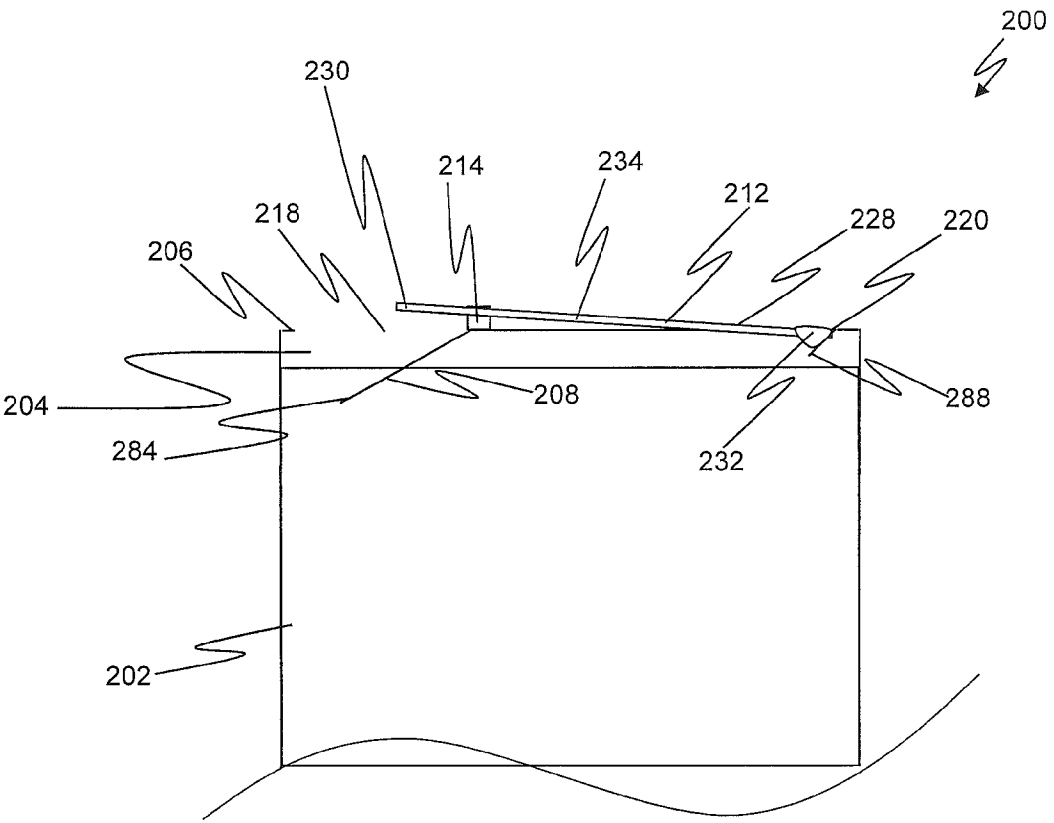
FIG. 11 is a cross-section of an improved container in accordance with the second embodiment.
Figure 12:
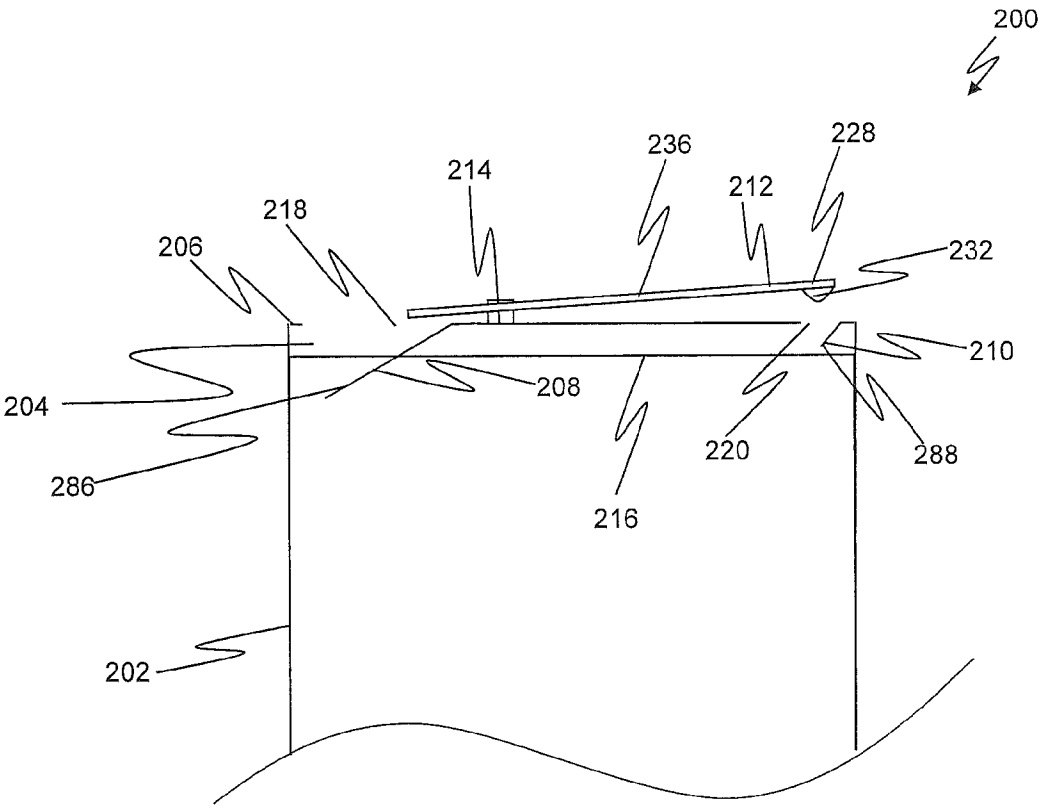
FIG. 12 is a cross-section of an improved container in accordance with the second embodiment.

Referring to FIG. 11, when the tab 212 is pushed down into the third position 234, at least one protruding instrument 232 pushes down on the second portion 210 causing the second portion 210 to at least partially separate from the container top 206 and move down into the container cavity 204. Separation and depression of the second portion 210 creates a second container opening 220. Referring to FIG. 12, the grip end 228 of the tab 212 is again raised upward and into the fourth position 236, removing at least one protruding instrument 232 from the second container opening 220. Once at least one protruding instrument 220 is removed, this second container opening 120 allows air to enter the container cavity 204 while the fluid 216 flows from the first can opening 208, thus creating a more even and steady pour.

Figure 13:
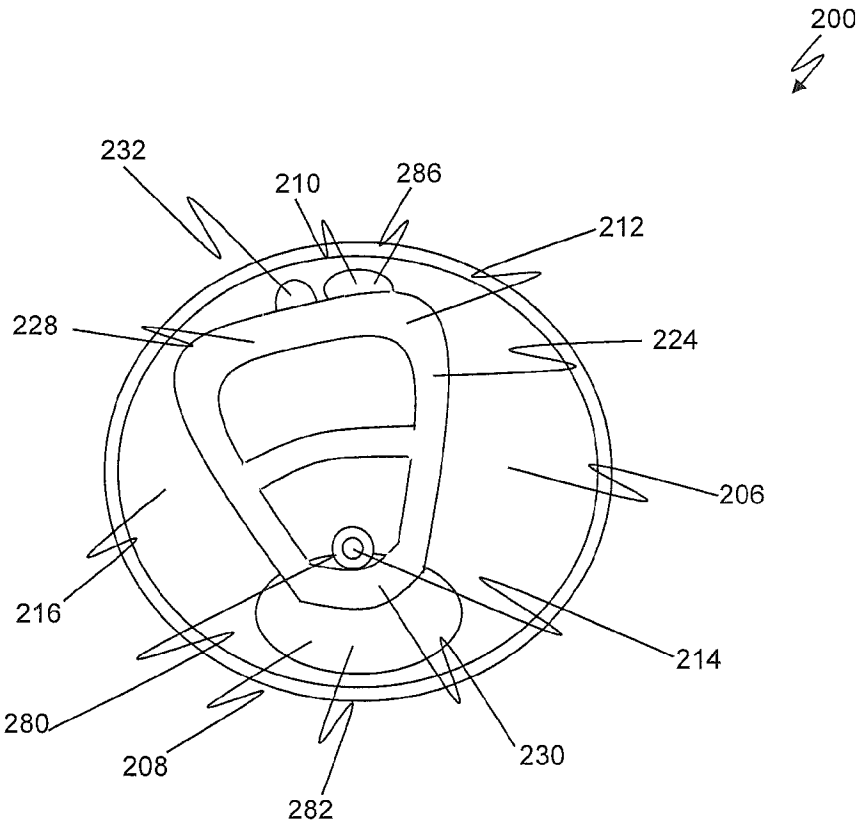
FIG. 13 is a top view of an improved container in accordance with the second embodiment.

Similarly to the first embodiment 100, it should be appreciated in the second embodiment 200 that the container body 202 and container top 206 may be made from any material suitable to containing the fluid 216, such as aluminum and tin. Additionally, the fluid 216 may be any gas, liquid, or combination thereof, including carbonated beverages such as soda, beer, and tonic. It should further be appreciated that the container top 206 may be molded from the same continuous piece of material as the container body 202, thus making the container body 202 and container top 206 a one piece, fluid containing device. Also, the attachment 214 of the tab 212 to the container top 206 may be achieved via any means suitable to the desired end purpose of moveable flexibility, including frictional, welding, and snap-on associations. Referring to FIG. 13, it should be additionally appreciated that when in the first position 224, the tab 212 may lie off-center in relation to the second portion 210, resting with at least one protruding instrument 232 adjacent to the container top 206, either to the left or right of the second portion 210. The tab 212 may then be slightly rotated to align with the second portion 210 and move into the third position 234. Still further, the at least one protruding instrument 232 may be configured to be capable of piercing any portion of the container body 202 or container top 206. Any at least one protruding instrument 232 with this ability, via sharpness, strength, or any other quality suitable to the desired end purpose of piercing the container body 202 and/or the container top 206, may be used and are anticipated by the present invention.

Figure 14:
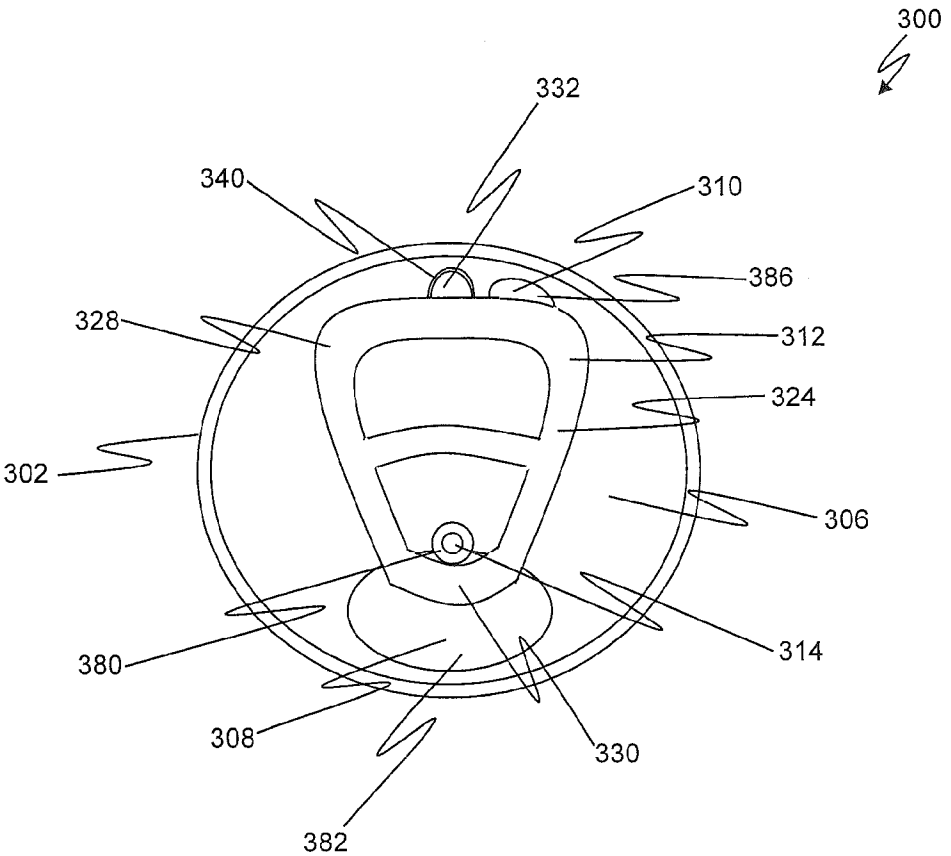
FIG. 14 is a top view of an improved container in accordance with a third embodiment.
Figure 15:
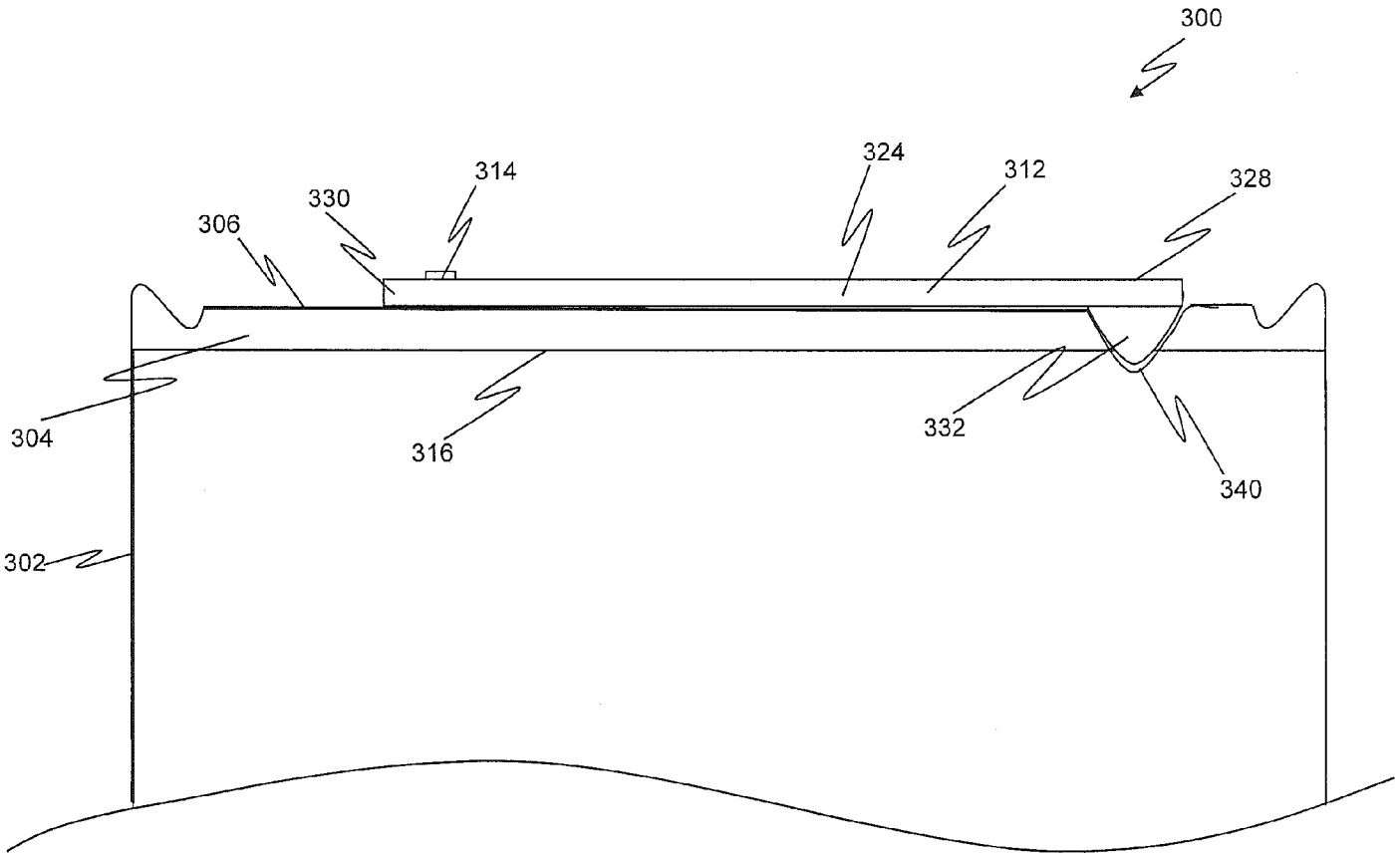
FIG. 15 is a cross-section of an improved container in accordance with the third embodiment.

Referring to FIGS. 14-23, a third exemplary embodiment of an improved container 300 is illustrated and includes a container body 302 defining a container cavity 304 containing a fluid 316. A container top 306 is also included, wherein the container top is associated with the container body 302 to sealingly enclose the container cavity 304. A tab 312 is additionally provided and includes a grip end 328, a depressing end 330, a protruding instrument 332 and a tab-securing ring 380. The tab-securing ring 380 is sized and shaped to securely associate the tab 312 to the container top 306 via an attaching structure 314. At least one of the container top 306 and tab 312 are configured to facilitate the creation of at least two openings in the container top 306. In order to facilitate the creation of these at least two openings, the container top 306 may include at least two areas for opening, as illustrated in FIG. 14 by a first portion 308 configurable between a closed configuration 382 and an open configuration 384, and a second portion 310 configurable between a closed configuration 386 and a open configuration 388. Referring to FIGS. 14 and 15, the container top 306 also defines an instrument cavity 340 positioned to house at least one protruding instrument 332 while the tab 312 is in the first position 324.

Figure 16:
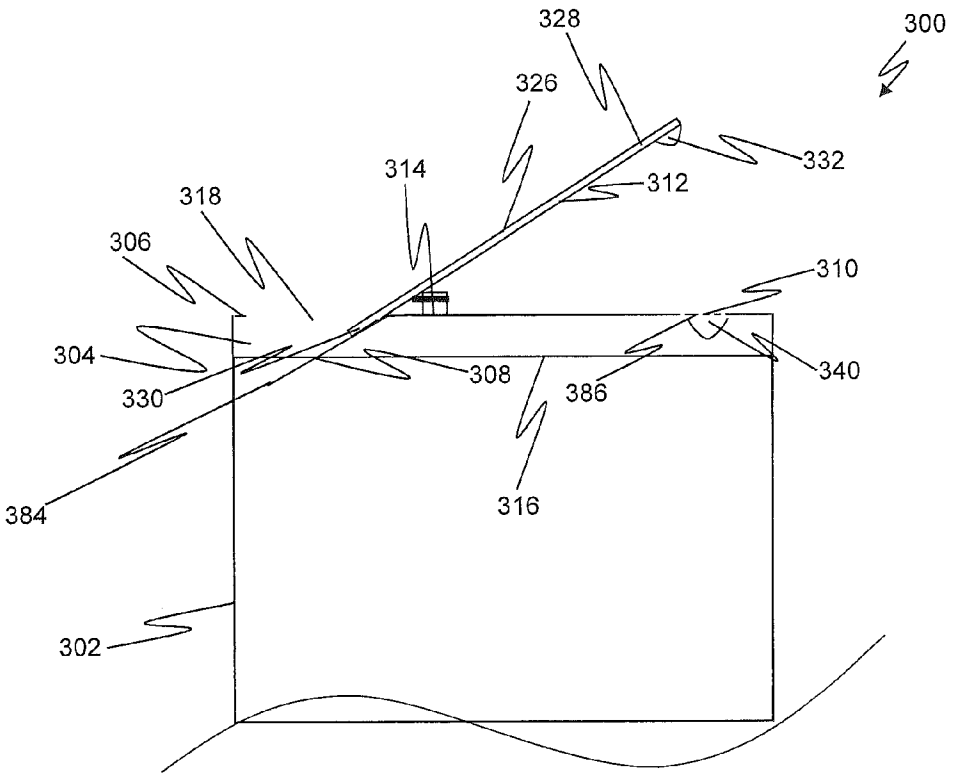
FIG. 16 is a cross-section of an improved container in accordance with the third embodiment.
Figure 17:
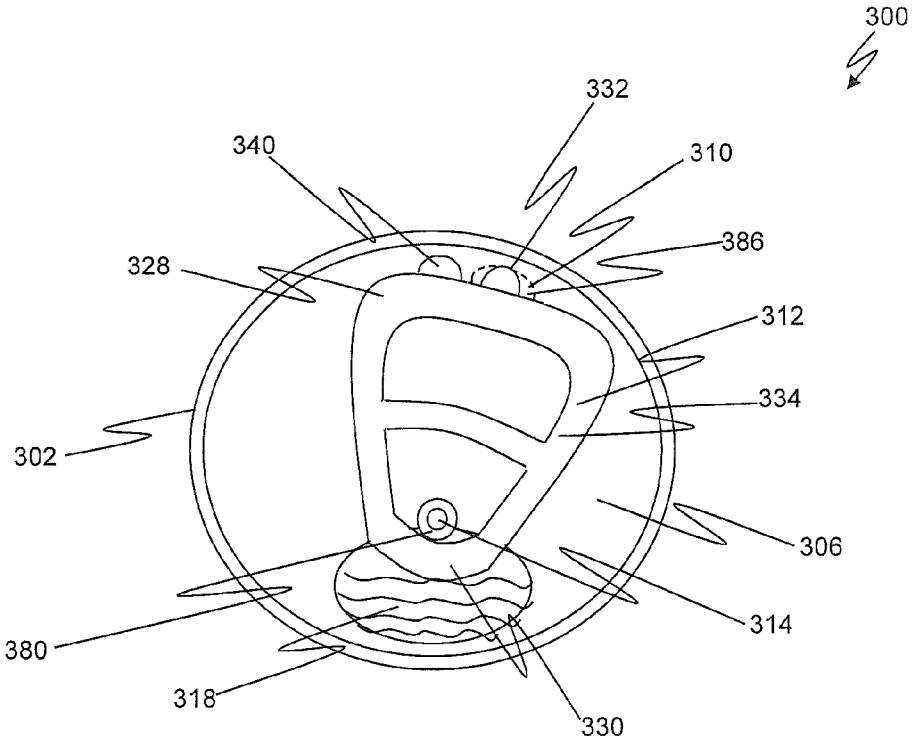
FIG. 17 is a top view of an improved container in accordance with the third embodiment.
Figure 18:
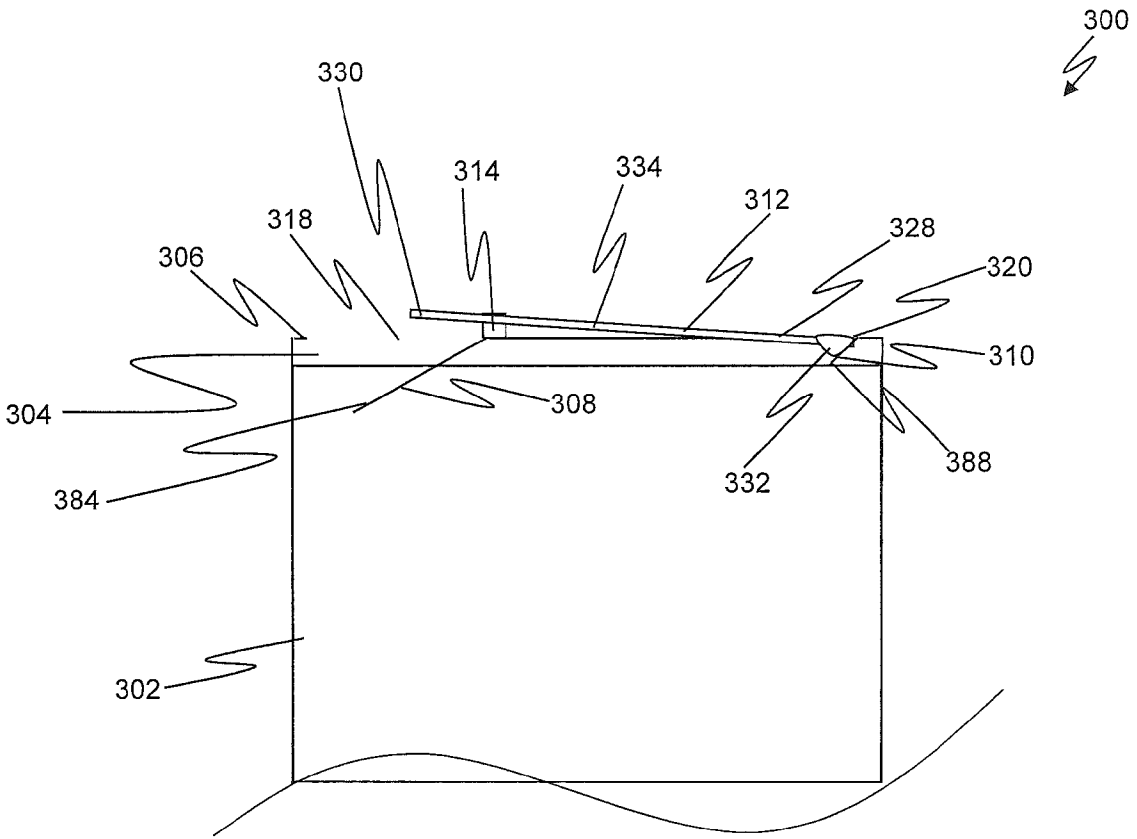
FIG. 18 is a cross-section of an improved container in accordance with the third embodiment.
Figure 19:
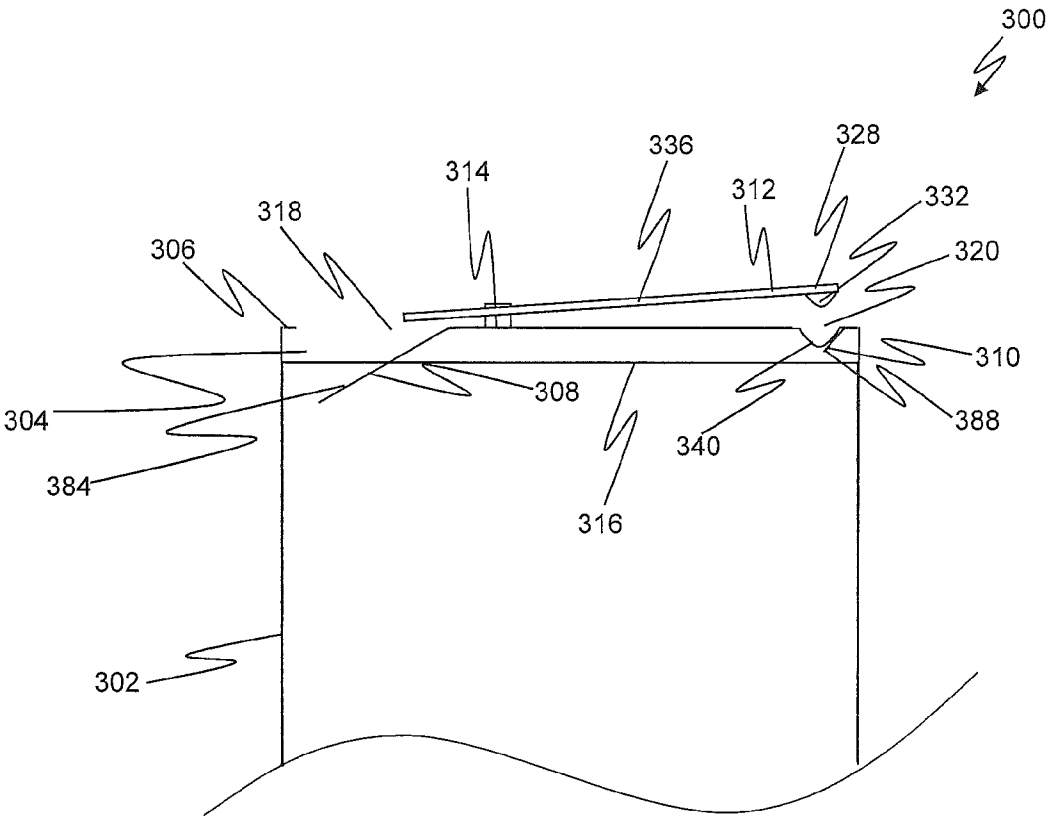
FIG. 19 is a cross-section of an improved container in accordance with the third embodiment.

Referring to FIG. 15, FIG. 16, FIGS. 17 and 18 (both of which illustrate a third position 334), and FIG. 19, the tab 312 is at least configurable between a first position 324, a second position 326, the third position 334, and a fourth position 336. Referring to FIG. 15, the tab 312 is illustrated in the first position 324, lying substantially parallel to the container top 306 with the depressing end 330 being disposed adjacent to the first portion 308. Referring to FIG. 16, as the grip end 328 is raised into the second position 326, the depressing end 330 pushes down on the first portion 308 causing the first portion 308 to at least partially separate from the container top 306 and move down into the container cavity 304. As FIG. 15 and FIG. 16 illustrate, raising the grip end 328 of the tab 312 causes the depressing end 330 to depress the first portion 308, creating a first container opening 318 which allows access to the fluid 316 within the container cavity 304.

Referring to FIG. 17, the tab 312 may then be rotated to align with the second portion 310 and pushed downward into the third position 334. Referring to FIG. 18, pushing the tab 312 into the third position 334 causes at least one protruding instrument 332 to engage upon the second portion 310, which in turn causes the second portion 310 to at least partially separate from the container top 306 and move down into the container cavity 304. Separation and depression of the second portion 310 creates a second container opening 320. Referring to FIG. 19, the grip end 328 of the tab 312 is again raised upward and into the fourth position 336, removing at least one protruding instrument 332 from the second container opening 320. Once at least one protruding instrument 320 is removed, the second container opening 320 may allow air to enter the improved container 300 via an opening other than the first container opening 318, which in turn allows the fluid 316 to flow from the first can opening 308 at a more even and steady rate.

Figure 20:
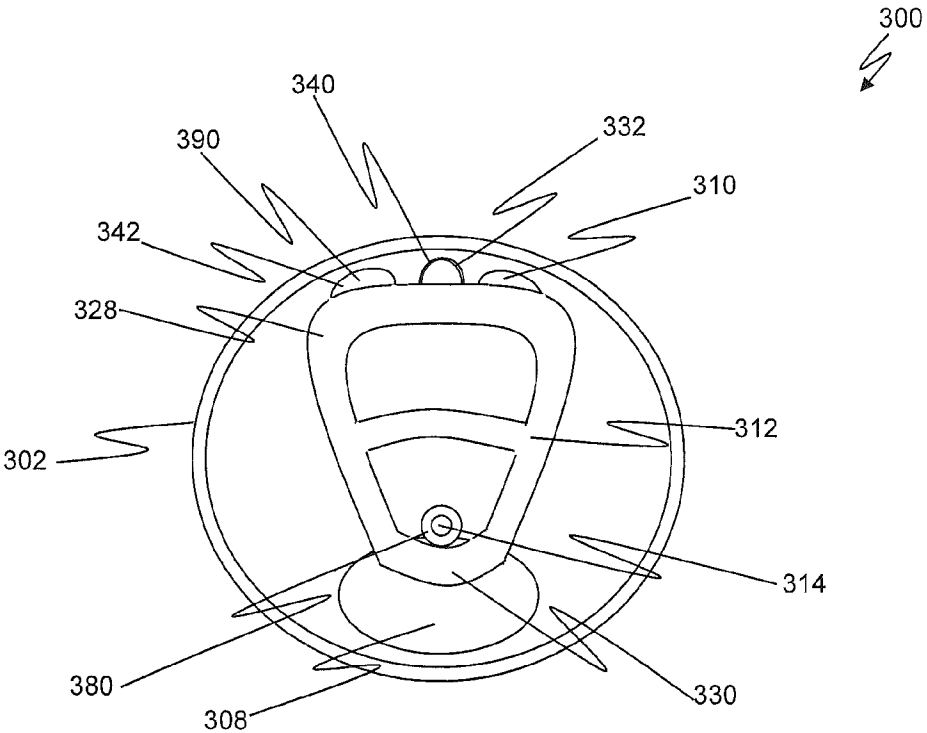
FIG. 20 is a top view of an improved container in accordance with the third embodiment.

Referring to FIG. 20, the third exemplary embodiment of an improved container 300 is shown with a container top 306 including a third portion 342. With the addition of the third portion 342, the tab 312 is further configurable into a fifth position 344, a sixth position 346, and a seventh position 394, illustrated respectively by FIGS. 21, FIG. 22 and FIG. 23.

Figure 21:
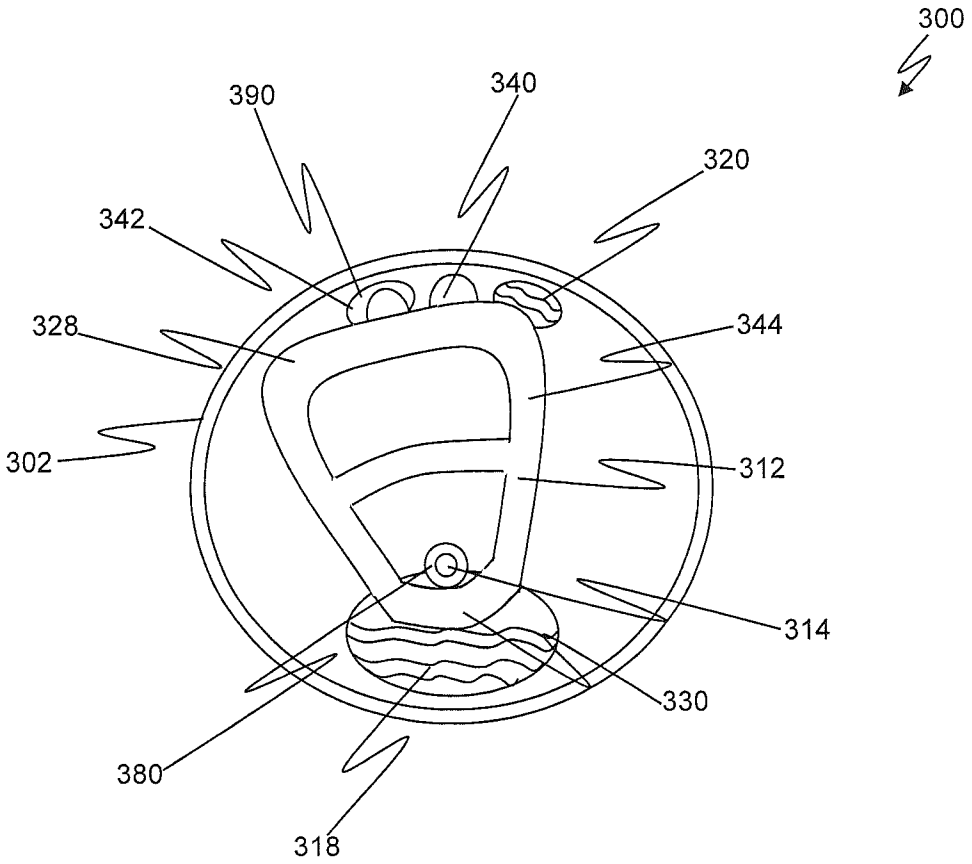
FIG. 21 is a top view of an improved container in accordance with the third embodiment.
Figure 22:
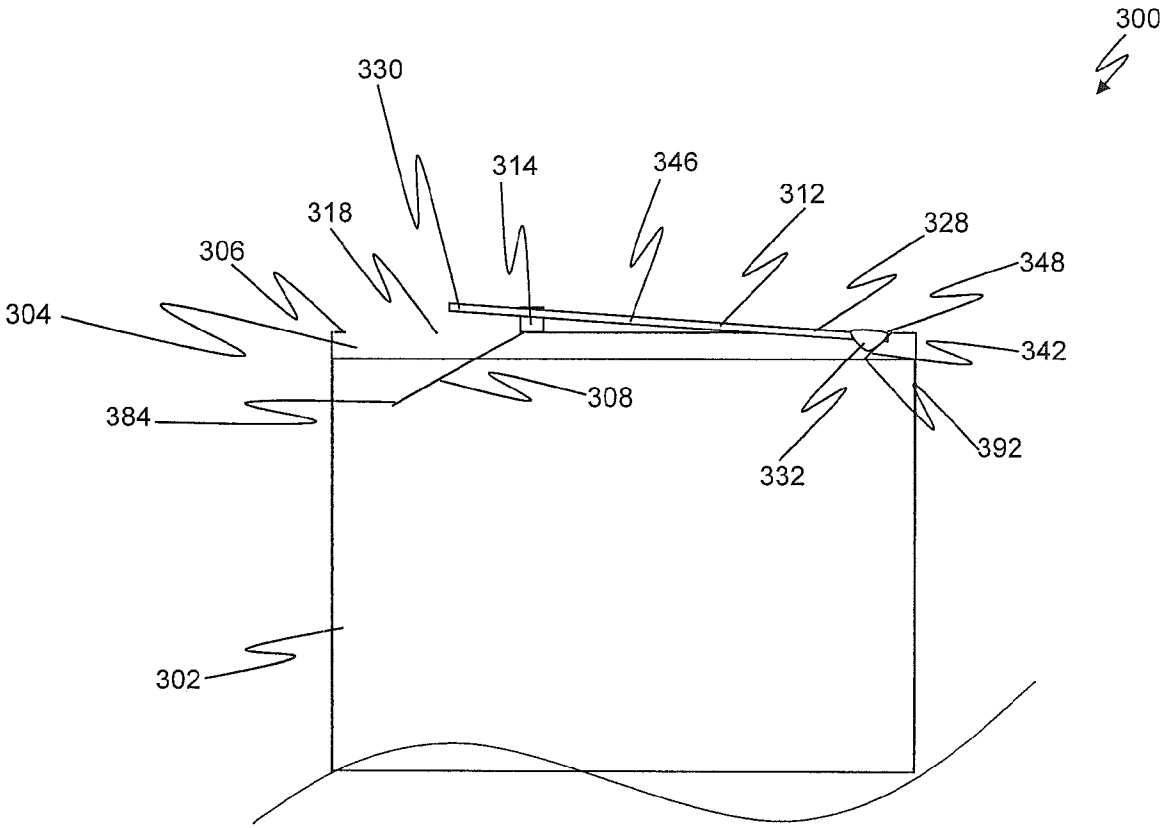
FIG. 22 is a cross-section of an improved container in accordance with the third embodiment.
Figure 23:
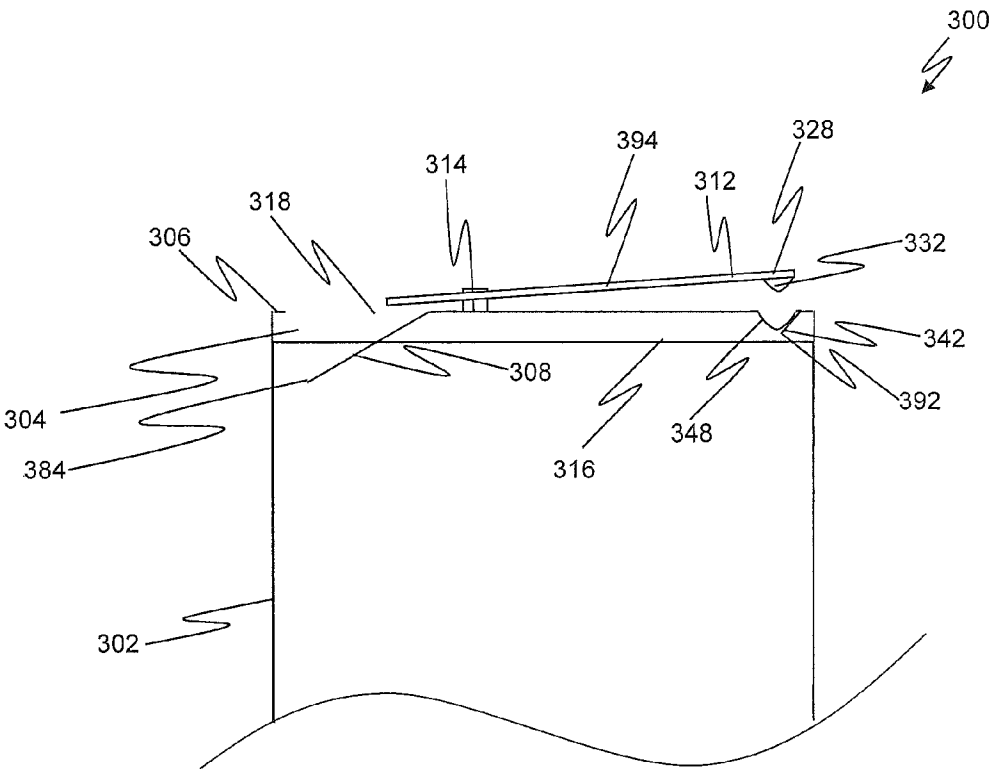
FIG. 23 is a cross-section of an improved container in accordance with the third embodiment.

Referring to FIG. 21, the third portion 342 is shown in a closed configuration 390. The tab 312 may be rotated from the fourth position 336, as shown in FIG. 19, to the fifth position 344 in order to align at least one protruding instrument 332 with the third portion 342. Referring to FIG. 22, the third portion 342 is shown in an open configuration 392, wherein the tab 312 is pushed into the fifth position 344 causing at least one protruding instrument 332 to engage upon the third portion 342, which in turn causes the third portion 342 to at least partially separate from the container top 306 and move down into the container cavity 304. Separation and depression of the third portion 342 creates a third container opening 348. Referring to FIG. 23, the grip end 328 of the tab 312 is once again raised upward and into the sixth position 346, removing at least one protruding instrument 332 from the third container opening 348. Once at least one protruding instrument 320 is removed, the third container opening 348 may allow air to enter the improved container 300 via an opening other than the first and second container openings 318 and 320, which in turn may allow the fluid 316 to flow from the first can opening 308 at a still more even and steady rate.

Similarly to the first embodiment 100 and second embodiment 200, it should be appreciated in the third embodiment 300 that the container body 302 and container top 306 may be made from any material suitable to containing the fluid 316, such as aluminum and tin. Additionally, the fluid 316 may be any gas, liquid, or combination thereof, including such carbonated beverages as soda, beer, and tonic. It should further be appreciated that the container top 306 may be molded from the same continuous piece of material as the container body 302, thus making the container body 302 and container top 306 a one piece, fluid containing device. Also, the attachment 314 of the tab 312 to the container top 306 may be achieved via any means suitable to the desired end purpose of moveable flexibility, including frictional, welding, and snap-on associations. Furthermore, the instrument cavity 340, second portion 310, and third portion 342 may be positioned in any relation to each other suitable to the desired ends of housing at least one protruding instrument 332 and improving the flow of the fluid 316. Still further, the at least one protruding instrument 332 may be configured to be capable of to piercing any portion of the container body 302 or container top 306. Any at least one protruding instrument 332 with this ability, via sharpness, strength, or any other quality suitable to the desired end purpose of piercing the container body 302 and/or the container top 306, may be used and are anticipated by the present invention.

Figure 24:
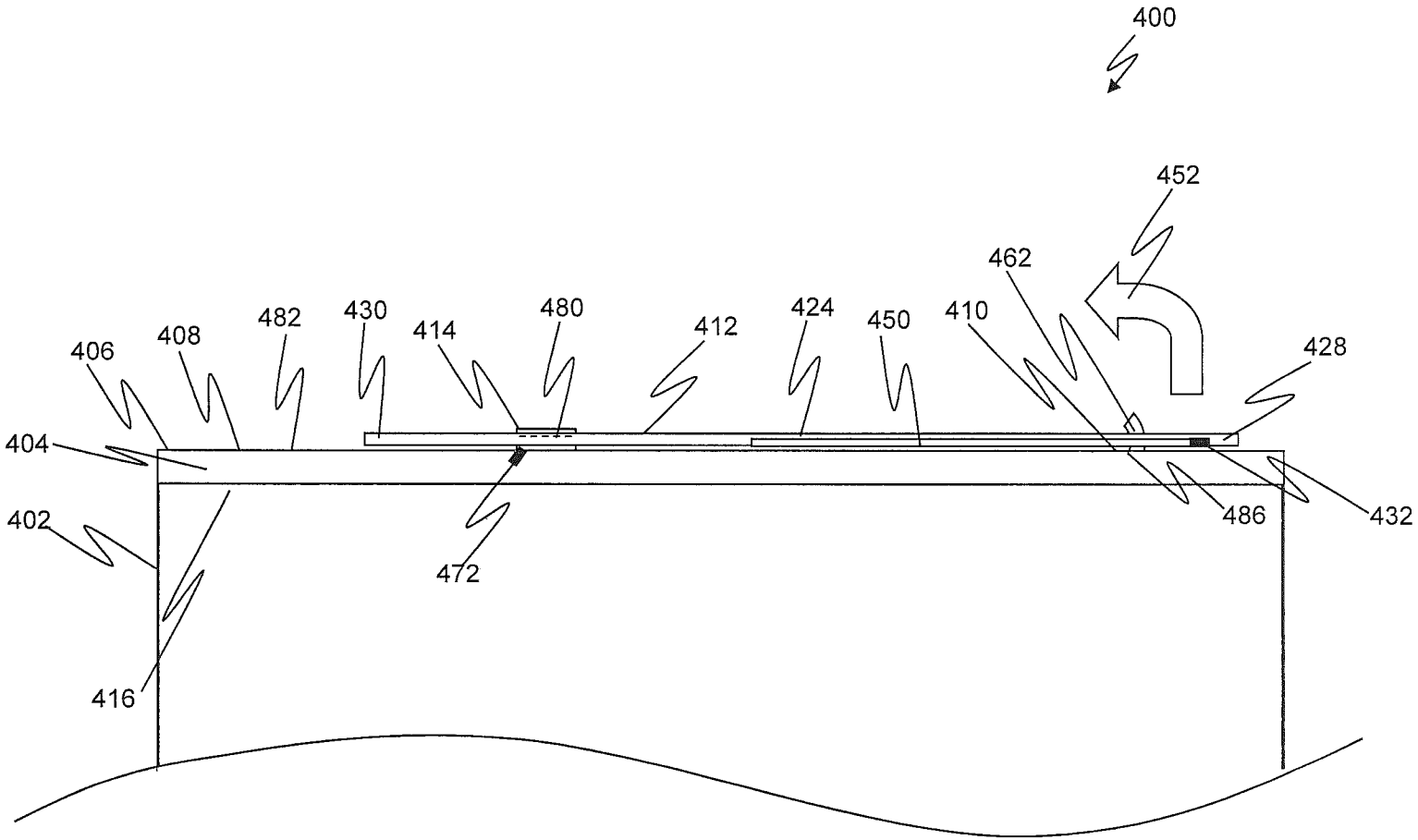
FIG. 24 is a cross-section view of an improved container in accordance with a fourth embodiment.
Figure 25:
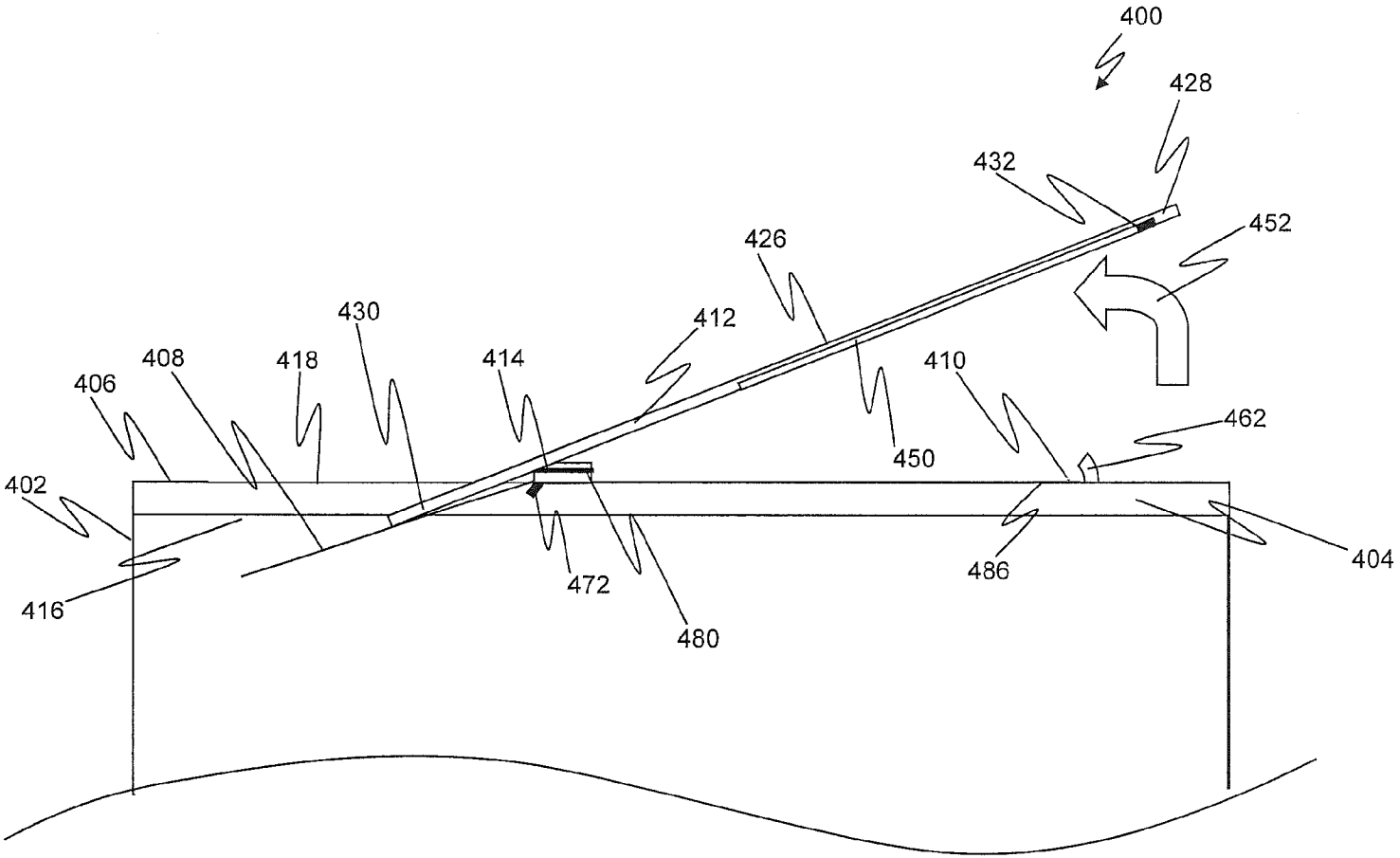
FIG. 25 is a cross-section of an improved container in accordance with the fourth embodiment.

Referring to FIGS. 24-30, a fourth exemplary embodiment of an improved container 400 is illustrated and includes a container body 402 defining a container cavity 404 containing a fluid 416. A container top 406 is also included, wherein the container top 406 is associated with the container body 402 to sealingly enclose the container cavity 404. A tab 412 is additionally provided and includes a grip end 428, a depressing end 430, a tab-securing ring 480, at least one protruding instrument 432, and an extending tab portion 450. The tab-securing ring 480 is sized and shaped to securely associate the tab 412 to the container top 406 via an attaching structure 414. At least one of the container top 406 and tab 412 are configured to facilitate the creation of at least two openings in the container top 406. In order to facilitate the creation of these at least two openings, the container top 406 may include at least two areas for opening, as illustrated in FIG. 24 by a first portion 408 configurable between a closed configuration 482 and an open configuration 484, and a second portion 410 configurable between a closed configuration 486 and a open configuration 488. Referring to FIG. 25, the tab may be configured with the container top 406 to depress and at least partially separate the first portion 408 and the second portion 410 from the container top 406, possibly via one continuous pulling motion 452 upon the grip end 428 (though movement is not limited to one continuous pulling motion 452, and a pushing force on the tab 412 that may be desirable will be discussed further along in the disclosure). The one continuous pulling motion 452 is represented in a first position 424, a second position 426, a third position 434, a fourth position 436, and a fifth position 444, as is illustrated respectively in FIG. 24, FIG. 25, FIGS. 26 and 27, FIGS. 28 and 29, and FIG. 30.

Referring to FIG. 24, the tab 412 is illustrated in the first position 424, lying substantially parallel to the container top 406 with the depressing end 430 being disposed adjacent to the first portion 408. Referring to FIG. 25, as the grip end 428 is raised into the second position 426, the depressing end 430 pushes down on the first portion 408 causing the first portion 408 to at least partially separate from the container top 406 and move down into the container cavity 404. This at least partial separation of the first portion 408 and the container top 406 creates a first container opening 418, which allows access to the fluid 416 within the container cavity 404.

Figure 26:
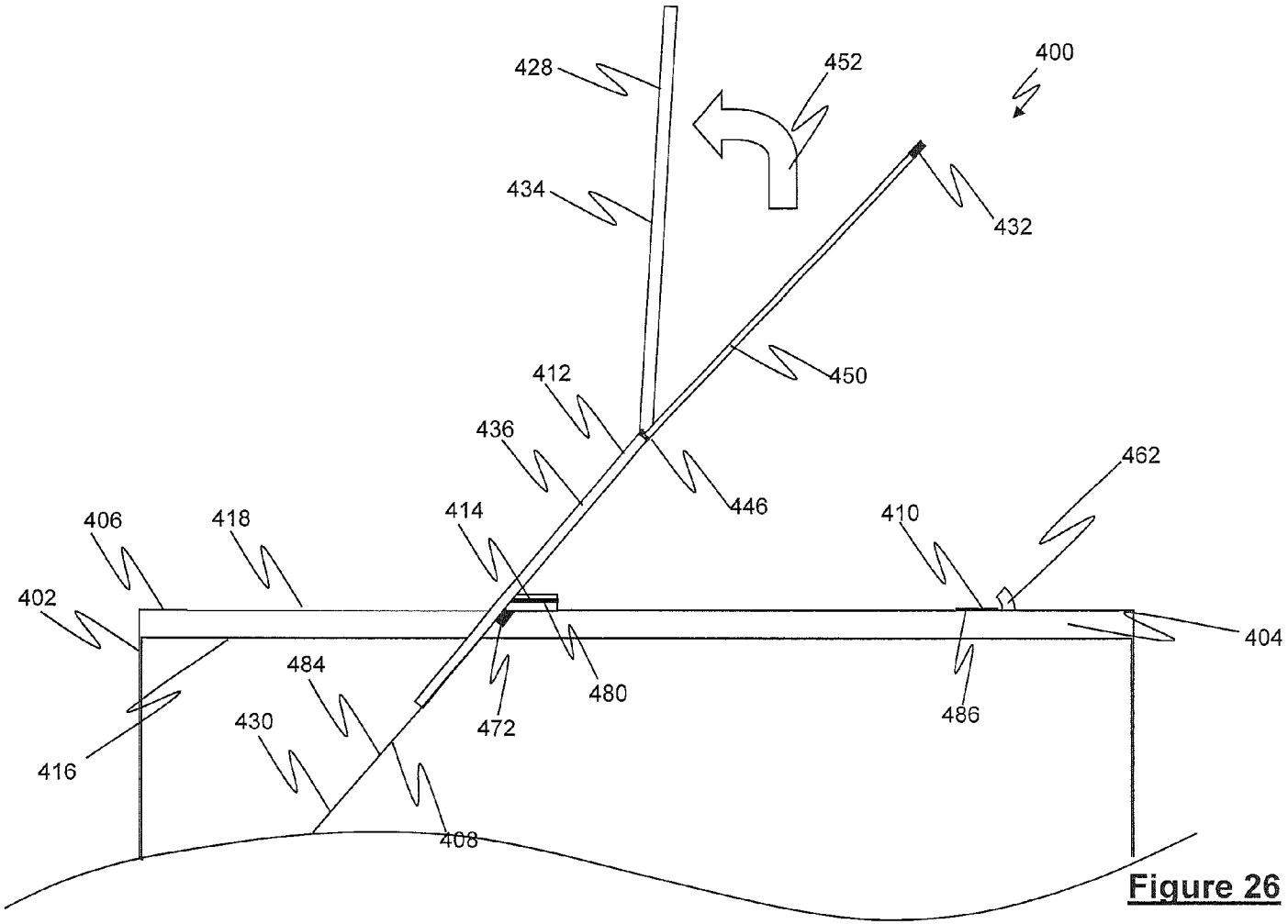
FIG. 26 is a cross-section of an improved container in accordance with the fourth embodiment.
Figure 27:
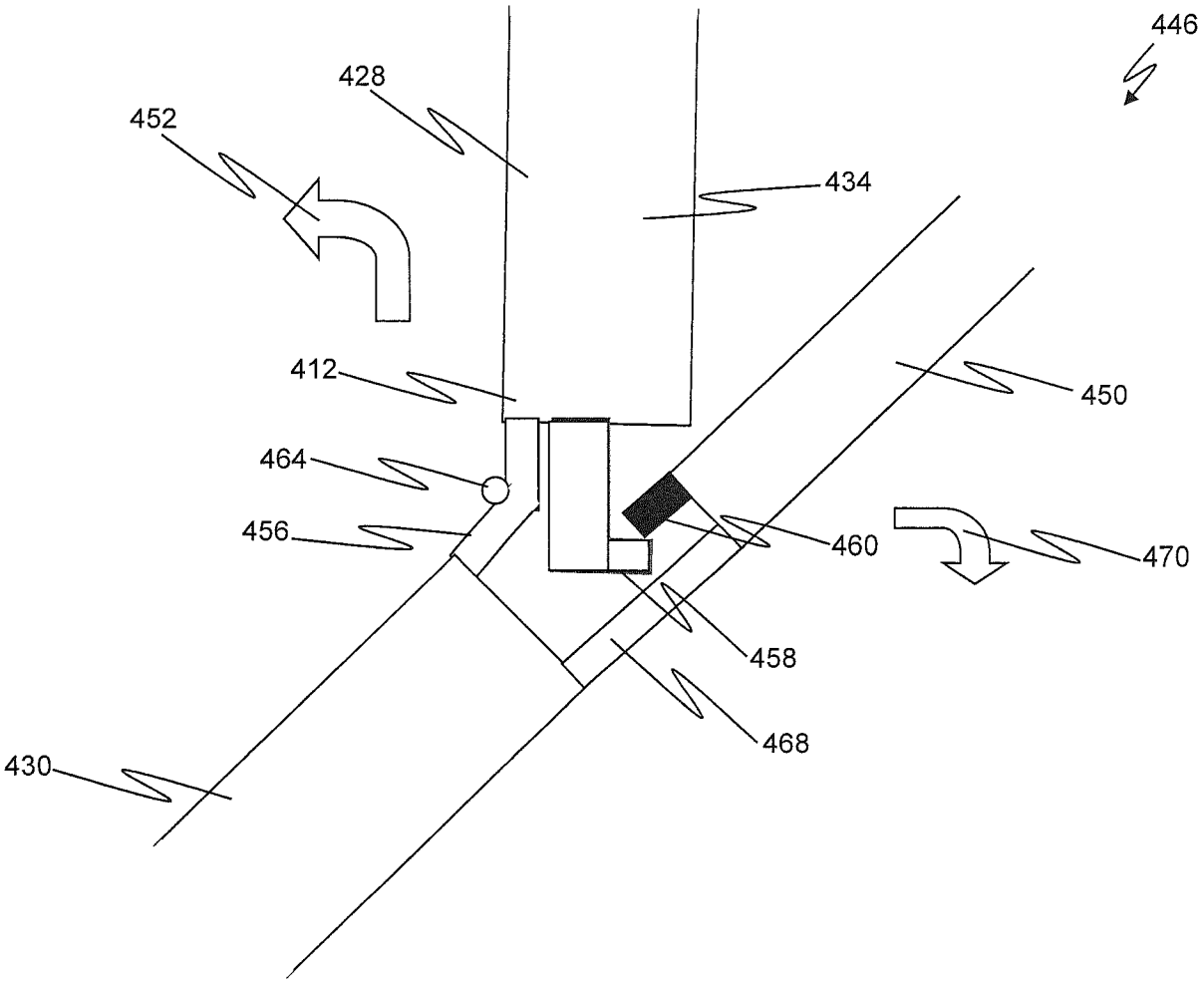
FIG. 27 is a side view of a tab in accordance with the fourth embodiment.

Referring to FIG. 26, a stopping device 472 is provided which may be associated with the with the container top 406, located within the container cavity 404. As the tab 412 is pulled into the third position 434 the depressing end 430 depresses the first portion 408 until contact is made with the first stopping device 472, which stops the depressing end 430 from depressing any further. An area of bending and actuation 446 may also be included, wherein upon contact with the stopping device 472 the area of bending and actuation 446 allows the grip end 428 of the tab 412 to bend toward the depressing end 430 of the tab 412, while the extending tab portion 450 begins to rotate towards the container top 406. Referring to FIG. 27, the area of bending and actuation 446 is shown in greater detail while in the third position 434, and includes a first bendable portion 456, a hooking device 458, a catching device 460, a second bendable portion 468, and a second stopping device 464. As shown in FIG. 27, the grip end 428 of the tab 412 begins to bend towards the depressing end 430 of the tab 412 along the first bendable portion 456. As the grip end 428 bends, the hooking device 458 attached to the grip end 428 makes contact with the catching device 460 attached to the extending tab portion 450, causing the extending tab portion 450 to rotate along the second bendable portion 468 (in a downward manner 470) toward the container top 406.

Figure 28:
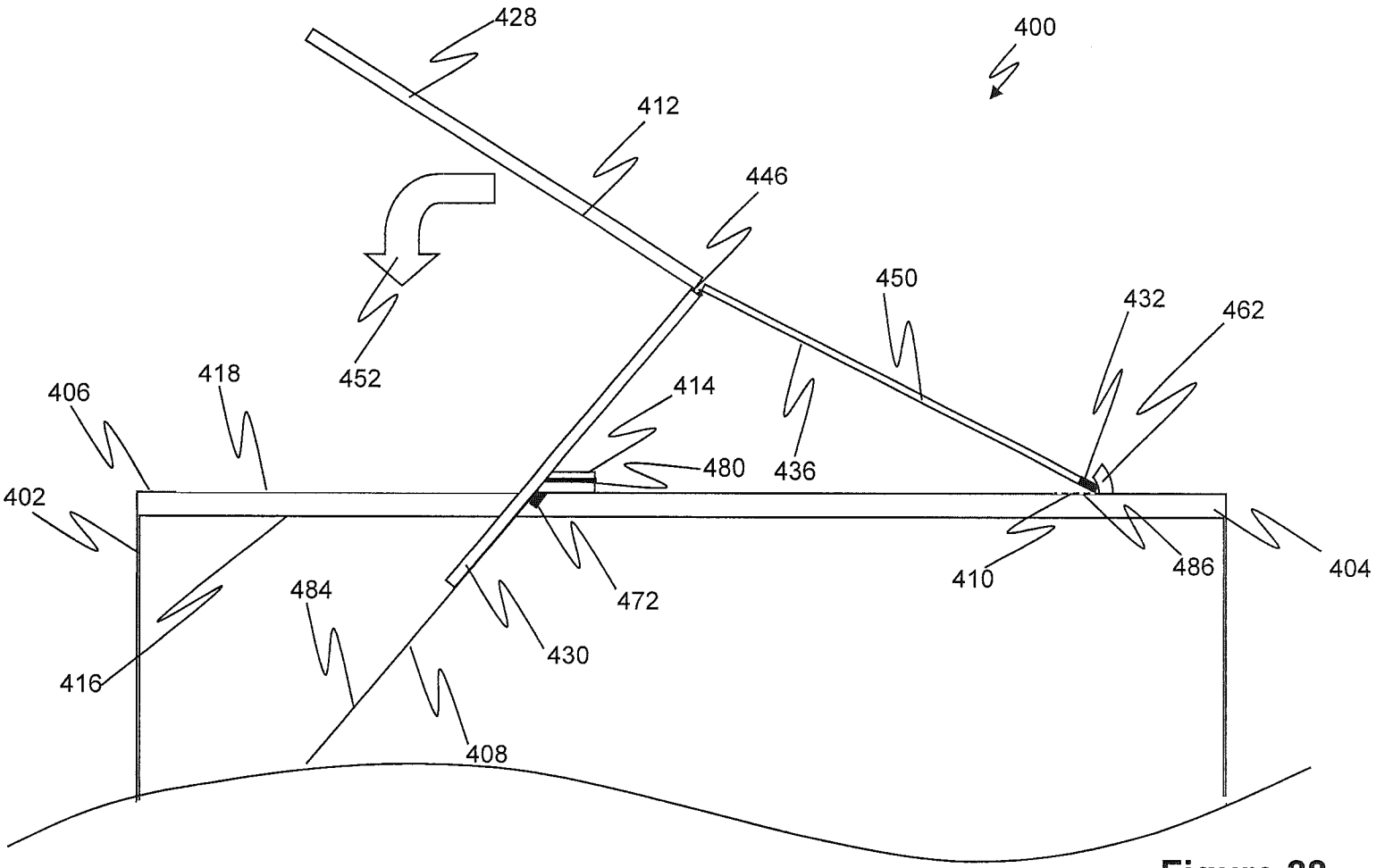
FIG. 28 is a cross-section of an improved container in accordance with the fourth embodiment.
Figure 29:
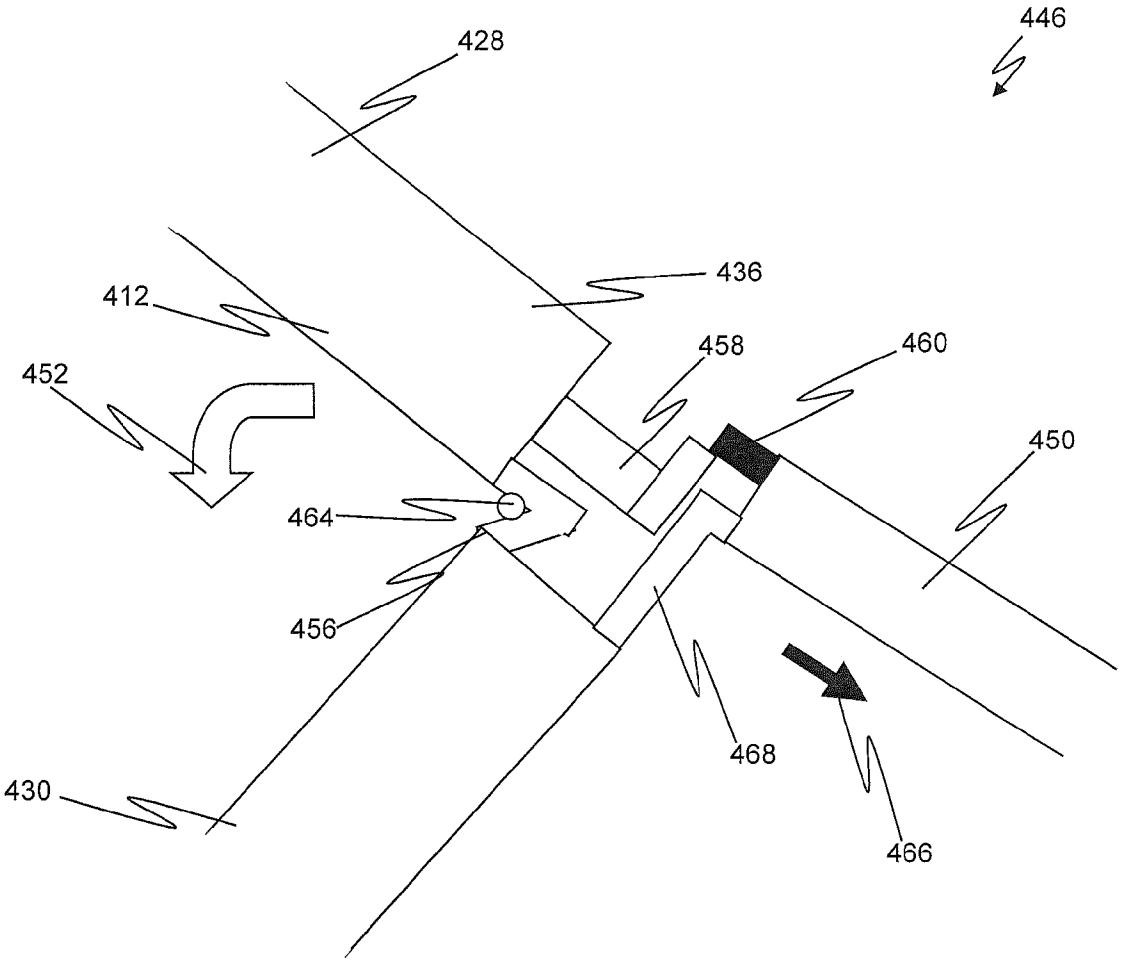
FIG. 29 is a side view of a tab in accordance with the fourth embodiment.

Referring to FIG. 28, a deflecting device 462 is provided which may be associated with the container top 406 adjacent to the second portion 410. While being pulled into the fourth position 436, the grip end 428 is further bent within the area of bending and actuation 446, and the extending tab portion 450 rotates along the area of bending and actuation 446 until at least one protruding instrument 432 attached to the end of the extending tab portion 450 makes contact with the deflecting device 462. Referring to FIG. 29, the area of bending and actuation 446 is illustrated in detail while in the fourth position 436. In FIG. 29, via the continuous pulling motion 452 the hooking device 458 has pushed upward on the catching device 460 until the extending tab portion 450 has rotated (bending along the second bendable portion 568) into the fourth position 436. Additionally, the grip end 428 may be bent until reaching the second stopping device 464 which stops the grip end from bending further, thus focusing the force of the continuous pulling motion 452 into a downward push 466 upon the extending tab portion 450. As was briefly mention above, this downward push 466 may be aided via a pushing force on the tab 412, the pushing force being applied to the grip end 428 of the tab 412 in a direction of the second portion 410.

Figure 30:
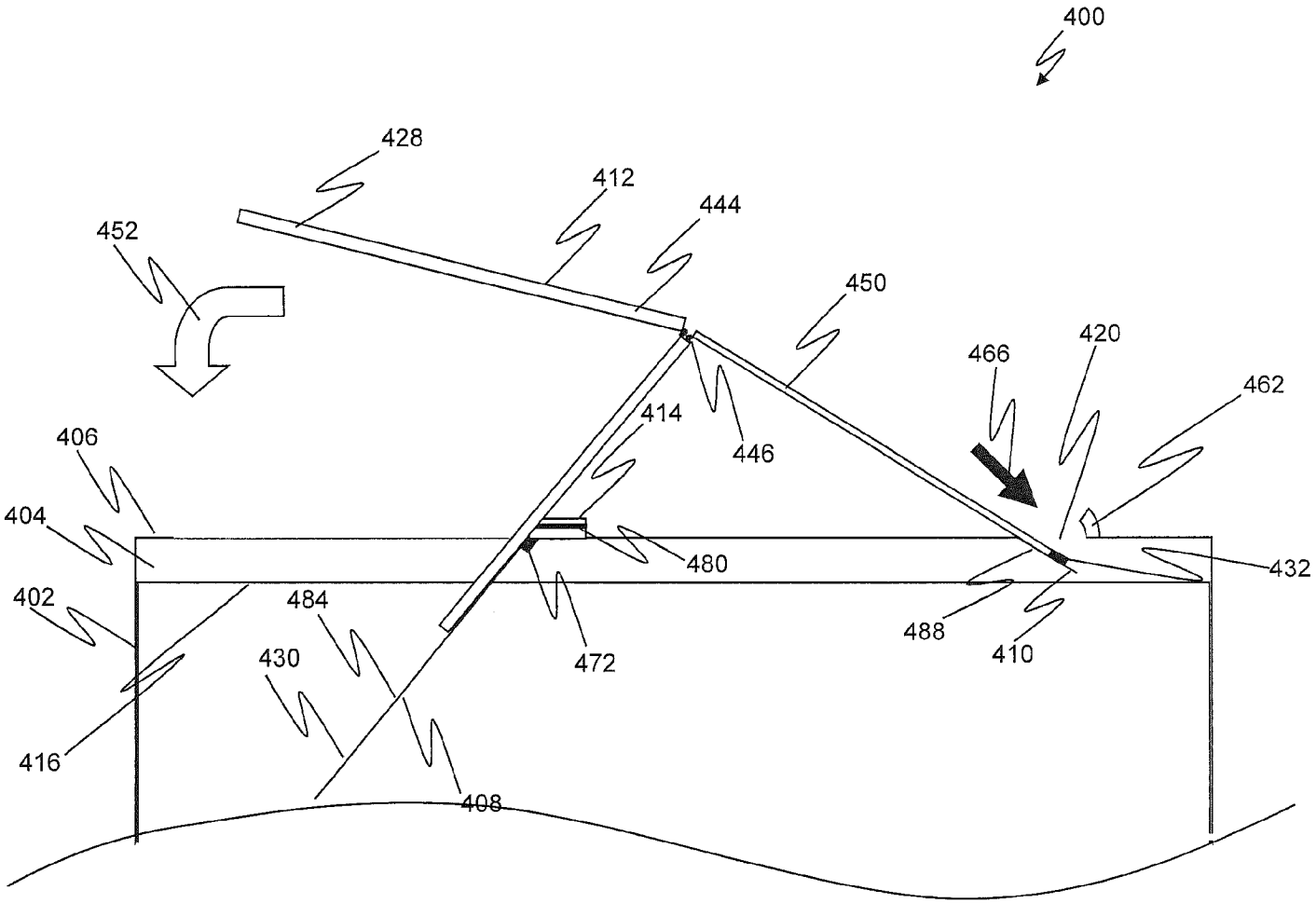
FIG. 30 is a cross-section of an improved container in accordance with the fourth embodiment.

Referring to FIG. 30, the downward push 466 causes the extending tab portion 450 to push at least one protruding instrument 432 into the deflecting device 462. The deflecting device 462 deflects at least one protruding instrument down onto the second portion 410 and into the fifth position 444. The deflecting device has a downward deflecting curvature that causes the second portion 410 to at least partially separate from the container top 406 and move down into the container cavity 404. Separation and depression of the second portion 410 creates a second container opening 420. Once at least one protruding instrument 420 is removed, the second container opening 420 may allow air to enter the improved container 400 via an opening other than the first container opening 418, which in turn allows the fluid 416 to flow from the first can opening 408 at a more even and steady rate.

It should be appreciated that the container body 402 and container top 406 may be made from any material suitable to containing the fluid 416, such as aluminum and tin. Additionally, the fluid 416 may be any gas, liquid, or combination thereof, including such carbonated beverages as soda, beer, and tonic. It should further be appreciated that the container top 406 may be molded from the same continuous piece of material as the container body 402, thus making the container body 402 and container top 406 a one piece, fluid containing device. Also, the attachment 414 of the tab 412 to the container top 406 may be achieved via any means suitable to the desired end purpose of moveable flexibility, including frictional, welding, and snap-on associations. Furthermore, it should be appreciated that the improved container 400 is just one means of creating multiple container openings via one continuous pulling motion 452 of the tab 412, and any means suitable to the desired end purpose may be used, including attaching the tab 412 to the second portion 410 in a manner that allows the one continuous pulling motion 452 of the tab 412 to pull the second portion 410 away form the container top 406 via an engaging of the extending tab portion 450 with a hooking portion (not illustrated) of the second portion 410. Still further, the at least one protruding device 432 may be configured to be capable of to piercing any portion of the container body 402 or container top 406. Any at least one protruding instrument 432 with this ability, via sharpness, strength, or any other quality suitable to the desired end purpose of piercing the container body 402 and/or the container top 404, may be used and are anticipated by the present invention.

Figure 31:
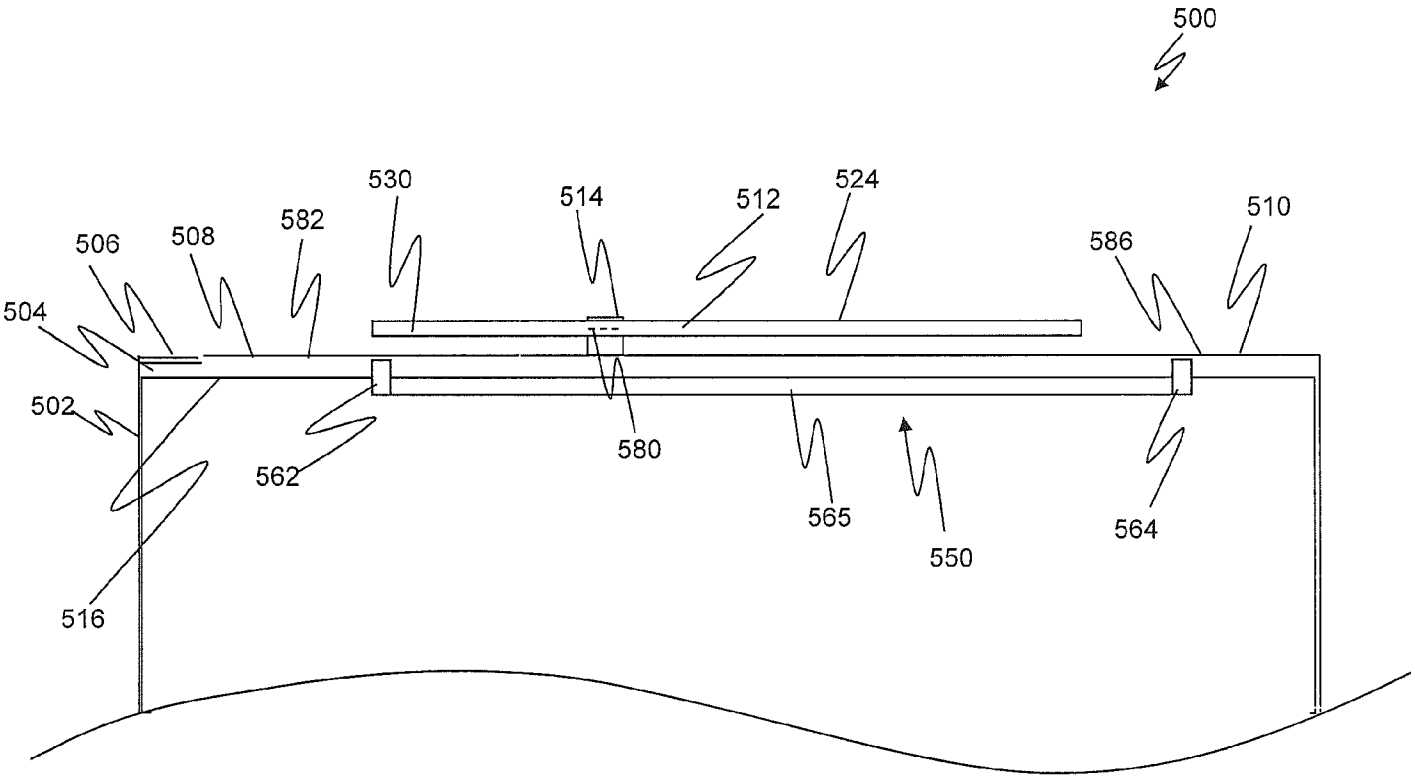
FIG. 31 is a cross-section of an improved container in accordance with a fifth embodiment.
Figure 32:
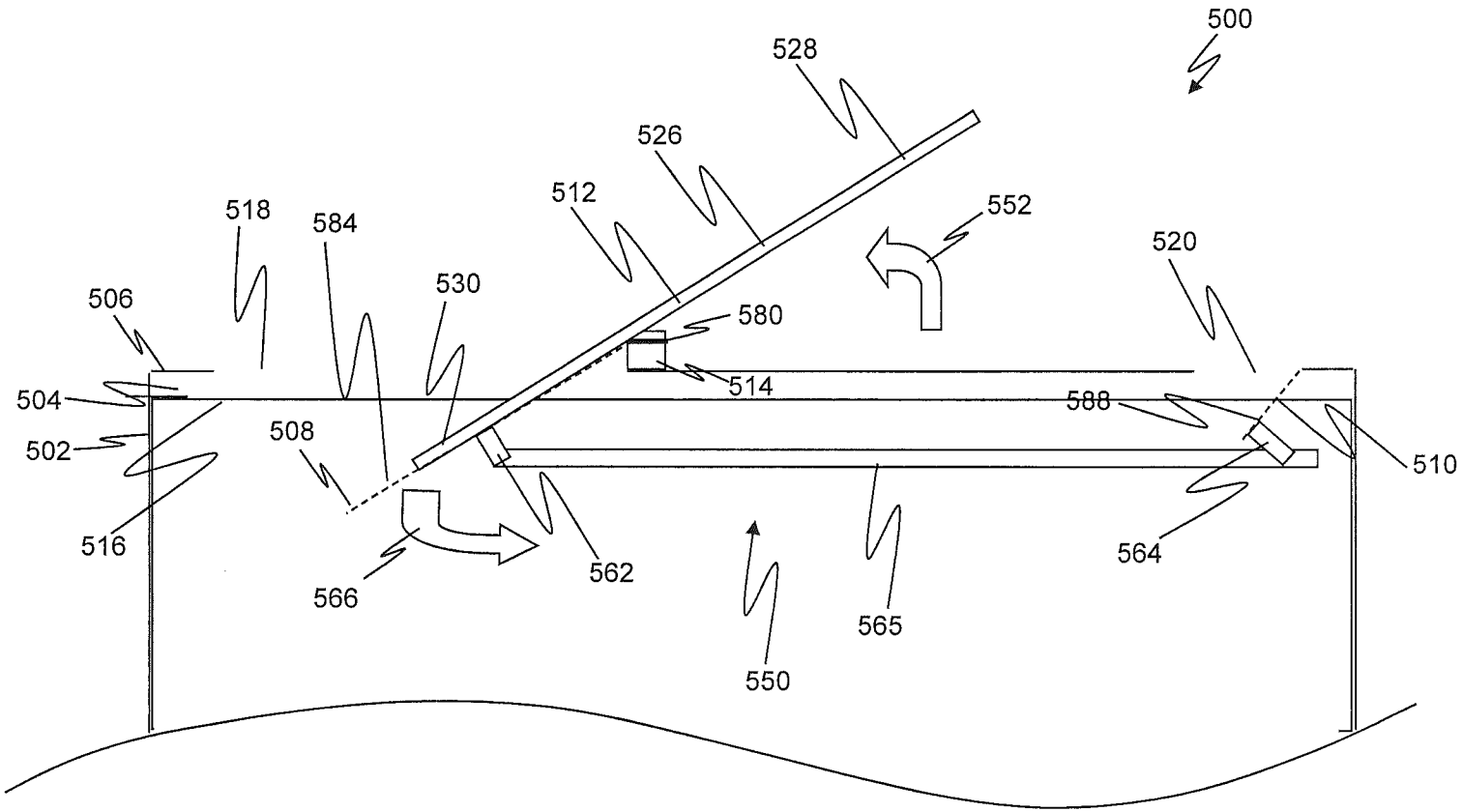
FIG. 32 is a cross-section of an improved container in accordance with the fifth embodiment.
Figure 33:
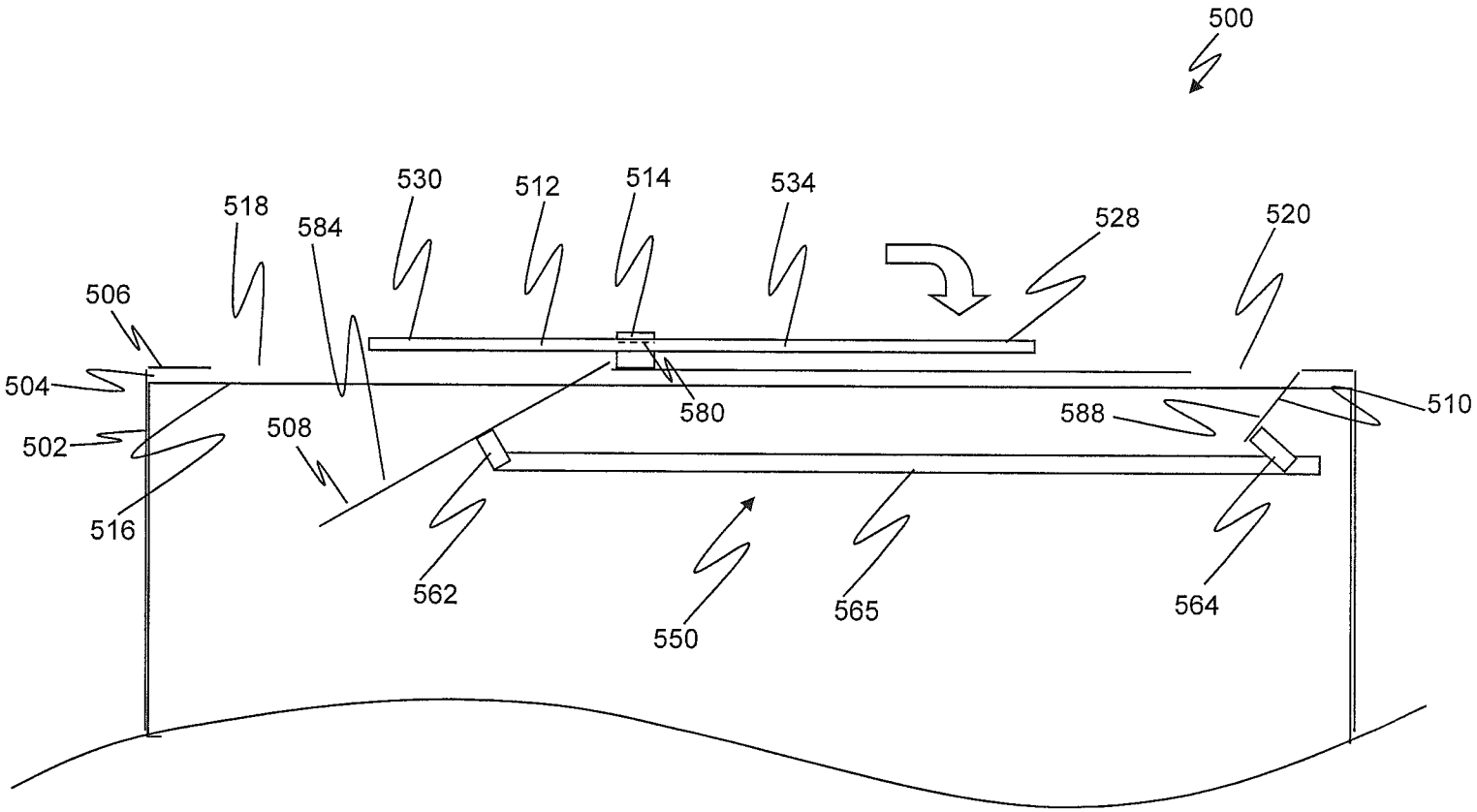
FIG. 33 is a cross-section of an improved container in accordance with the fifth embodiment.

Referring to FIGS. 31-33, a fifth exemplary embodiment of an improved container 500 is illustrated and includes a container body 502 defining a container cavity 504 containing a fluid 516. A container top 506 is also included, wherein the container top 506 is associated with the container body 502 to sealingly enclose the container cavity 504. A tab 512 is additionally provided and includes a grip end 528, a depressing end 530, and a tab-securing ring 580. The tab-securing ring 580 is sized and shaped to securely associate the tab 512 to the container top 506 via an attaching structure 514. At least one of the container top 506 and tab 512 may be configured to facilitate the creation of at least two openings in the container top 506. In order to facilitate the creation of these at least two openings, the container top 506 includes at least two areas for opening, as illustrated in FIG. 31 by a first portion 508 configurable between a closed configuration 582 and an open configuration 584, and a second portion 510 configurable between a closed configuration 586 and a open configuration 588. A cavity device 550 including a first portion structure 562, a second portion structure 564, and a cavity bar 565 is also illustrated, wherein the first portion structure 562 and second portion structure 564 are at least partially rotateable about an association of each with the cavity bar 550. The first portion structure 562 and second portion structure 564 are further associated with the first portion 508 and second portion 510, wherein, referring to FIG. 25, the tab is configured with the container top 506 and cavity device 550 to depress and at least partially separate the first portion 508 and the second portion 510 from the container top 506, possibly via one continuous pulling motion 552 upon the grip end 528 (though movement is not limited to one continuous pulling motion 552). The one continuous pulling motion 552 is represented in a first position 524, a second position 526, and a third position 534, as is illustrated respectively in FIG. 31, FIG. 32, and FIG. 33.

Referring to FIG. 31, the tab 512 is illustrated in the first position 524, lying substantially parallel to the container top 506 with the depressing end 530 being disposed adjacent to the first portion 508. Referring to FIG. 32, as the grip end 528 is raised into the second position 526, the depressing end 530 pushes down on the first portion 508 causing the first portion 508 to at least partially separate from the container top 506 and move down into the container cavity 504. This at least partial separation of the first portion 508 and the container top 506 creates a first container opening 518, which allows access to the fluid 516 within the container cavity 504. As the first portion 510 moves down into the container cavity 504, the first portion structure 562 moves the cavity device 550 in the direction of the second portion 510. This movement 566 causes the cavity device 550 to pull upon the second portion structure 564, which in turn pulls the second portion 510 into the open configuration 588, creating a second container opening 520. Once the second container opening 520 is created, air may enter the improved container 500 via an opening other than the first container opening 518, which in turn allows the fluid 516 to flow from the first can opening 508 at a more even and steady rate. Referring to FIG. 33, the tab 512 may then be pushed down into the third position 534, removing the depressing end 530 of the tab 512 from the first container opening 518.

It should be appreciated that the container body 502 and container top 506 may be made from any material suitable to containing the fluid 516, such as aluminum and tin. Additionally, the fluid 516 may be any gas, liquid, or combination thereof, including such carbonated beverages as soda, beer, and tonic. It should further be appreciated that the container top 506 may be molded from the same continuous piece of material as the container body 502, thus making the container body 502 and container top 506 a one piece, fluid containing device. Also, the attachment 514 of the tab 512 to the container top 506 may be achieved via any means suitable to the desired end purpose of moveable flexibility, including frictional, welding, and snap-on associations. Furthermore, it should be appreciated that the improved container 500 is just one means of creating multiple container openings via one continuous pulling motion 552 of the tab 512, and any means suitable to the desired end purpose may be used, including the second portion structure 564 being associated with the second portion 510 in a manner that allows the one continuous pulling motion 552 of the tab to push the second portion 510 away from the container cavity 504.

Figure 34:
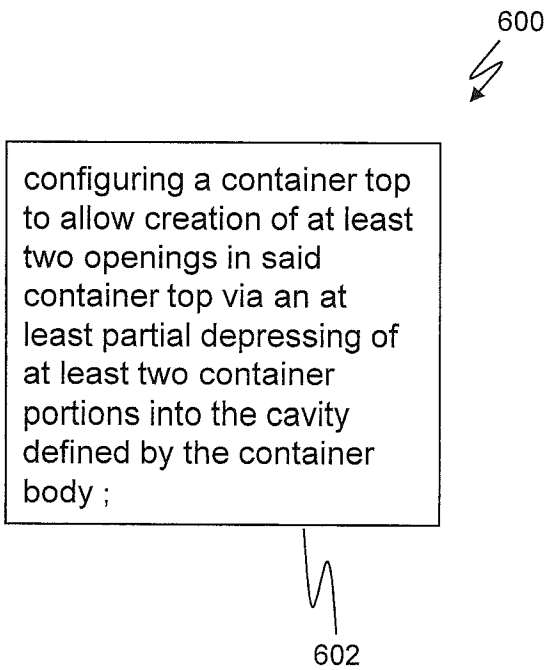
FIG. 34 is a block diagram illustrating a method for implementing an improved container.

Referring to FIG. 34, a method 600 for improving a flow of a fluid from a container is illustrated and includes configuring a container top to allow creation of at least two openings in said container top via an at least partial depressing of at least two container portions into the cavity defined by the container body, as shown in Operational Block 602. The depressing may be achieved via at least one of pulling and pushing a tab that is moveably and rotateably associated with the container top.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or substance to the teachings of the invention without departing from the scope thereof. Therefore, it is important that the invention not be limited to the particular embodiment disclosed as the best mode contemplated for carrying out this invention, but that the invention will include all embodiments falling within the scope of the apportioned claims. Moreover, unless specifically stated any use of the terms first, second, etc. do not denote any order or importance, but rather the terms first, second, etc. are used to distinguish one element from another.

What is claimed is:

1. A container including a container body defining a container cavity comprising:

a container top configured for creation of at least two container openings via an at least partial separation of at least two container portions from said container top said at least two container portions including at least a first portion and a second portion, said second portion occupying a lesser total area of the container top than said first portion; and a tab that is affixed to said container top at a single attachment point such that said tab remains affixed to said container top following said at least partial separation of said at least two container portions, said tab including a pull end, wherein one of said at least two container portions is disposed a greater distance from said single attachment point than another of said at least two container portions, wherein a substantial area of said second portion is disposed outside of an outer perimeter of said tab when said tab is in a non-raised position overlapping with said first portion, wherein said tab is configured to at least partially separate at least one of said at least two container portions from said container top, and wherein the first portion and the second portion are not in diametrical opposition.

2. The container of claim 1, wherein said at least partial separation of said at least two container portions is an at least partial depression of said at least two container portions into the container cavity.

3. The container of claim 1, wherein, when in said non-raised position, said tab is configured and positioned to depress said first portion into the container cavity via a raising of pull end.

4. The container of claim 1, wherein said substantial area of said second portion is greater than one half of an entire area occupied by said second portion.

5. A container including a container body defining a container cavity comprising:

a container top configured for creation of at least two container openings via an at least partial separation of at least two container portions from said container top said at least two container portions including at least a first portion and a second portion, said second portion occupying a lesser total area of the container top than said first portion; and a tab that is affixed to said container top at a single attachment point such that said tab remains affixed to said container top following said at least partial separation of said at least two container portions, said tab including a pull end and a depressing end opposite said pull end, wherein one of said at least two container portions is disposed a greater distance from said single attachment point than another of said at least two container portions, and wherein a substantial area of said second portion is disposed outside of an outer perimeter of said tab when said tab is in a non-raised position, and when said depressing end at least partially overlaps with said first portion such that said depressing end is configured to depress said first portion into the container cavity via a raising of said pull end.

6. The container of claim 1, wherein the first portion and the second portion are not in diametrical opposition along a bisector that bisects each of the first portion and the second portion into substantially equal parts.

* * * * *